US011148255B2

(12) United States Patent
Wang et al.

(10) Patent No.: US 11,148,255 B2
(45) Date of Patent: Oct. 19, 2021

(54) COATED ABRASIVES HAVING AGGREGATES

(71) Applicants: SAINT-GOBAIN ABRASIVES, INC., Worcester, MA (US); SAINT-GOBAIN ABRASIFS, Conflans-Sainte-Honorine (FR)

(72) Inventors: Jianna Wang, Grafton, MA (US); Shih-Chieh Kung, Worcester, MA (US); Sujatha K. Iyengar, Northborough, MA (US); Doruk O. Yener, Bedford, MA (US); Darrell K. Everts, Schenectady, NY (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 0 days.

(21) Appl. No.: 16/230,084

(22) Filed: Dec. 21, 2018

(65) Prior Publication Data

US 2019/0202031 A1 Jul. 4, 2019

Related U.S. Application Data

(60) Provisional application No. 62/610,707, filed on Dec. 27, 2017.

(51) Int. Cl.

| | |
|---|---|
| ***B24D 3/30*** | (2006.01) |
| ***B24D 3/28*** | (2006.01) |
| ***B24D 3/00*** | (2006.01) |

(52) U.S. Cl.
CPC ..... *B24D 3/30* (2013.01); *B24D 3/004* (2013.01); *B24D 3/285* (2013.01)

(58) Field of Classification Search
CPC .. C09K 3/1409; C09K 3/1436; C09K 3/1427; C09K 3/1418; C09K 21/02;
(Continued)

(56) References Cited

U.S. PATENT DOCUMENTS 4,652,275 A * 3/1987 Bloecher ..... B24D 3/32 51/298
5,078,753 A * 1/1992 Broberg ..... B24D 3/28 51/298

(Continued)

FOREIGN PATENT DOCUMENTS

WO WO-9520469 A1 * 8/1995 ..... B24D 11/00
WO 2013003699 A2 1/2013
WO 2015155610 A2 10/2015

OTHER PUBLICATIONS

Goy et al., "A Review of the Antimicrobial Activity of Chitosan," Ciência e Tecnologia, 2009, pp. 241-247, vol. 19, No. 3.

(Continued)

*Primary Examiner* — Pegah Parvini
*Assistant Examiner* — Ross J Christie
(74) *Attorney, Agent, or Firm* — Abel Schillinger, LLP; Joseph Sullivan

(57) ABSTRACT

The present disclosure relates generally to coated abrasive articles that include a grinding aid aggregates in a make coat, a size coat, a supersize coat, or combinations thereof, as well as methods of making coated abrasive articles.

18 Claims, 15 Drawing Sheets

(58) Field of Classification Search
CPC ..... B24D 18/0072; B24D 11/00; B24D 2203/00; B24D 3/00; B24D 11/04; B24D 3/28; B24D 3/14; B24D 11/001; B24D 3/20; B24D 11/02; B24D 18/00; B24D 3/001; B24D 7/02; B24D 11/005; B24D 18/0054; B24D 3/344; B24D 13/08; B24D 3/002; B24D 3/004; B24D 3/18; B24D 3/34; B24D 3/348; B24D 99/00; B24D 13/04; B24D 13/12; B24D 18/0018; B24D 18/0027; B24D 18/0063; B24D 3/005; B24D 3/06; B24D 3/285; B24D 3/30; B24D 3/342; B24D 3/346
See application file for complete search history.

(56) References Cited

U.S. PATENT DOCUMENTS

| | | | | |
|---|---|---|---|---|
| 5,417,726 | A | 5/1995 | Stout et al. | |
| 5,454,750 | A | 10/1995 | Cosmano et al. | |
| 5,498,268 | A | 3/1996 | Gagliardi et al. | |
| 5,505,747 | A | 4/1996 | Chesley et al. | |
| 5,520,711 | A | 5/1996 | Helmin | |
| 5,551,962 | A | 9/1996 | Ho | |
| 5,562,745 | A * | 10/1996 | Gagliardi | B24D 3/344 51/298 |
| 5,565,011 | A | 10/1996 | Follett et al. | |
| 5,573,619 | A | 11/1996 | Benedict et al. | |
| 5,578,098 | A | 11/1996 | Gagliardi et al. | |
| 5,702,811 | A | 12/1997 | Ho et al. | |
| 5,738,695 | A * | 4/1998 | Harmer | B24D 3/344 51/295 |
| 6,039,775 | A | 3/2000 | Ho et al. | |
| 6,270,543 | B1 | 8/2001 | Gagliardi et al. | |
| 9,555,520 | B2 | 1/2017 | Schoch et al. | |
| 2014/0013675 | A1 * | 1/2014 | Tian | B24B 27/0633 51/309 |
| 2014/0290147 | A1 * | 10/2014 | Seth | B24D 18/0054 51/298 |
| 2015/0183089 | A1 * | 7/2015 | Iyengar | B24D 11/00 451/28 |
| 2017/0087692 | A1 | 3/2017 | Schoch et al. | |

OTHER PUBLICATIONS

Shepherd et al., "Antibacterial Action of 2-Bromo-2-Nitropropane-1,3-Diol (Bronopol)," Antimicrobial Agents and Chemotherapy, 1988, pp. 1693-1698, vol. 32, No. 11.

Payne et al., "Tannic Acid Inhibits *Staphylococcus aureus* Surface Colonization in an IsaA-Dependent Manner," Infection and Immunity, 2013, pp. 496-504, vol. 81, No. 2.

"Bronopol Antimicrobial Product Safety Assessment," Dow, 2013, 6 pgs, The Dow Chemical Company.

International Search Report and Written Opinion for PCT/US2018/067196, dated Apr. 9, 2019, 11 Seiten.

* cited by examiner

COATED ABRASIVES HAVING AGGREGATES

CROSS-REFERENCE TO RELATED APPLICATION(S)

This application claims priority under 35 U.S.C. § 119(e) to U.S. Patent Application No. 62/610,707 entitled "COATED ABRASIVES HAVING AGGREGATES," by Jianna Wang et al., filed Dec. 27, 2017, which application is assigned to the current assignee hereof and incorporated herein by reference in its entirety.

FIELD OF THE INVENTION

The present disclosure relates generally to coated abrasive articles that include a grinding aid aggregates in a make coat, a size coat, a supersize coat, or combinations thereof, as well as methods of making coated abrasive articles.

BACKGROUND

Abrasive articles, such as coated abrasives, are used in various industries to machine work pieces, such as by lapping, grinding, and polishing. Surface processing using abrasive articles spans a wide industrial scope from initial coarse material removal to high precision finishing and polishing of surfaces at a submicron level. Effective and efficient abrasion of metal surfaces, particularly iron-carbon alloys, such as carbon steel and stainless steel, and nickel-chromium alloys, such as Inconel, which are required for high performance oxidation resistant and corrosion resistant applications, pose numerous processing challenges.

Industries that produce or rely on such alloys are sensitive to factors that influence operational costs, including the speed at which a surface can be prepared, the cost of the materials used to prepare that surface, and the costs associated with the time expended to prepare a surface. Typically, industry seeks to achieve cost effective abrasive materials and processes that achieve high material removal rates. However, abrasives and abrasive processes that exhibit high removal rates often also tend to exhibit poor performance, if not impossibility, in achieving desired surface characteristics associated with high precision finishing and polishing of surfaces. Conversely, abrasives that produce such desirable surface characteristics often have low material removal rates, which can require more time and effort to remove a sufficient amount of surface material.

Therefore, there continues to be a demand for improved abrasive products and methods that can offer enhanced abrasive processing performance, efficiency, and improved surface quality.

BRIEF DESCRIPTION OF THE DRAWINGS

The present disclosure can be better understood, and its numerous features and advantages made apparent to those skilled in the art by referencing the accompanying drawings.

Figure 1:
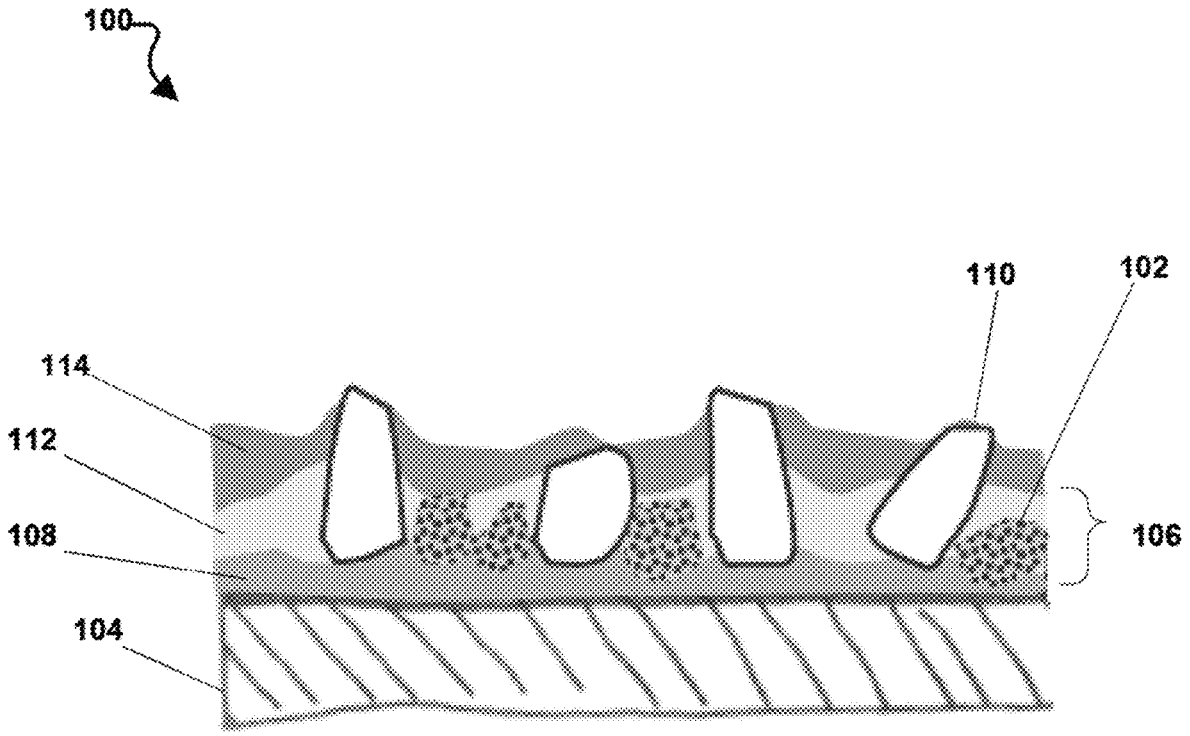
FIG. 1 is an illustration of a cross sectional view of an embodiment of a coated abrasive article that includes a grinding aid aggregate disposed on a make coat.

Skilled artisans appreciate that elements in the figures are illustrated for simplicity and clarity and have not necessarily been drawn to scale.

DETAILED DESCRIPTION

The following description, in combination with the figures, is provided to assist in understanding the teachings disclosed herein. The following discussion will focus on specific implementations and embodiments of the teachings. This discussion is provided to assist in describing the teachings and should not be interpreted as a limitation on the scope or applicability of the teachings.

The term "averaged," when referring to a value, is intended to mean an average, a geometric mean, or a median value. As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but can include other features not expressly listed or inherent to such process, method, article, or apparatus. As used herein, the phrase "consists essentially of" or "consisting essentially of" means that the subject that the phrase describes does not include any other components that substantially affect the property of the subject.

Further, unless expressly stated to the contrary, "or" refers to an inclusive-or and not to an exclusive-or. For example, a condition A or B is satisfied by any one of the following:

A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Further, references to values stated in ranges include each and every value within that range. When the terms "about" or "approximately" precede a numerical value, such as when describing a numerical range, it is intended that the exact numerical value is also included. For example, a numerical range beginning at "about 25" is intended to also include a range that begins at exactly 25. Moreover, it will be appreciated that references to values stated as "at least about," "greater than," "less than," or "not greater than" can include a range of any minimum or maximum value noted therein.

As used herein, the phrase "average particle diameter" can be reference to an average, mean, or median particle diameter, also commonly referred to in the art as $D_{50}$.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and can be found in textbooks and other sources within the coated abrasive arts.

Coated Abrasive Article

Referring to FIG. 1, a coated abrasive article 100 is illustrated in cross-section. As depicted, the coated abrasive article 100 can include a substrate 104 (also called herein a backing material) on which an abrasive layer 106 can be disposed. The abrasive layer 106 can include abrasive particles 110 (also called herein abrasive grains) and aggregates 102 disposed on a polymeric make coat binder composition 108 and a polymeric size coat binder composition 112 disposed over the abrasive particles and the polymeric make coat binder composition. In an embodiment, a grinding aid in the form of an aggregate 102 can also be disposed on the polymeric make coat binder composition 108. Optionally, a polymeric supersize coat binder composition 114 can be disposed on the abrasive layer 106.

Figure 2:
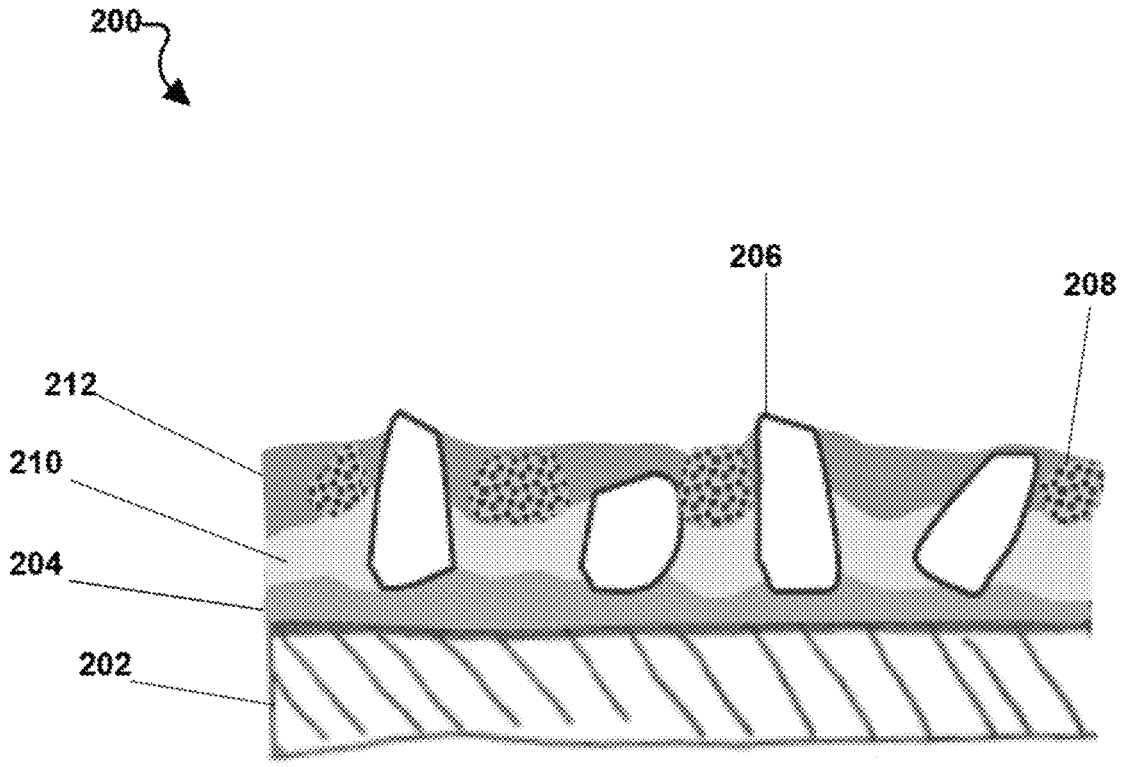
FIG. 2 is an illustration of a cross sectional view of an embodiment of a coated abrasive article that includes a grinding aid aggregate disposed on a size coat.

In FIG. 2, an embodiment of a coated abrasive article 200 is illustrated in cross-section. As depicted, the coated abrasive article 200 can include a polymeric make coat binder composition 204 (i.e., a make coat) disposed on a substrate 202 (backing material). Abrasive particles 206 (also called herein abrasive grains) can be disposed on the polymeric make coat binder composition. A polymeric size coat binder composition 210 can be disposed over the abrasive particles and the polymeric make coat binder composition. A grinding aid 208 in the form of an aggregate can also be disposed on the polymeric size coat binder composition 210. Optionally, a polymeric supersize coat composition 212 can be disposed over the size coat.

Abrasive Article

In an embodiment the abrasive article can be a fixed abrasive article. Fixed abrasive articles can include coated abrasive articles, bonded abrasive articles, nonwoven abrasive articles, engineered abrasive articles, and combinations thereof. Abrasive articles can be in the form of sheets, discs, belts, tapes, wheels, thin wheels, flap wheels, flap discs, polishing films, and the like. In a particular embodiment, the abrasive article may comprise a disc. In a particular embodiment, the abrasive article may comprise a belt. In another particular embodiment, the abrasive article may comprise an abrasive disc.

In certain embodiments, the abrasive article can be a bonded abrasive article comprising a plurality of abrasive particles and a bond matrix composition, wherein the abrasive particles are dispersed in the bond matrix composition.

In an alternative embodiment, the abrasive article can be a coated abrasive article comprising a backing material, a binder composition (also called herein a "make coat" composition, or a make coat) disposed on the backing, and composite abrasive aggregates disposed on or in the binder composition.

In an alternative embodiment, the abrasive article can be a coated abrasive article comprising a backing material, a binder composition disposed on a backing (also called herein a "make coat" composition, or a make coat), abrasive particles disposed on or in the binder composition, a size coat disposed on the abrasive particles and the make coat, and composite abrasive aggregates disposed on or in the size coat.

Method of Making a Coated Abrasive Article

Figure 3:
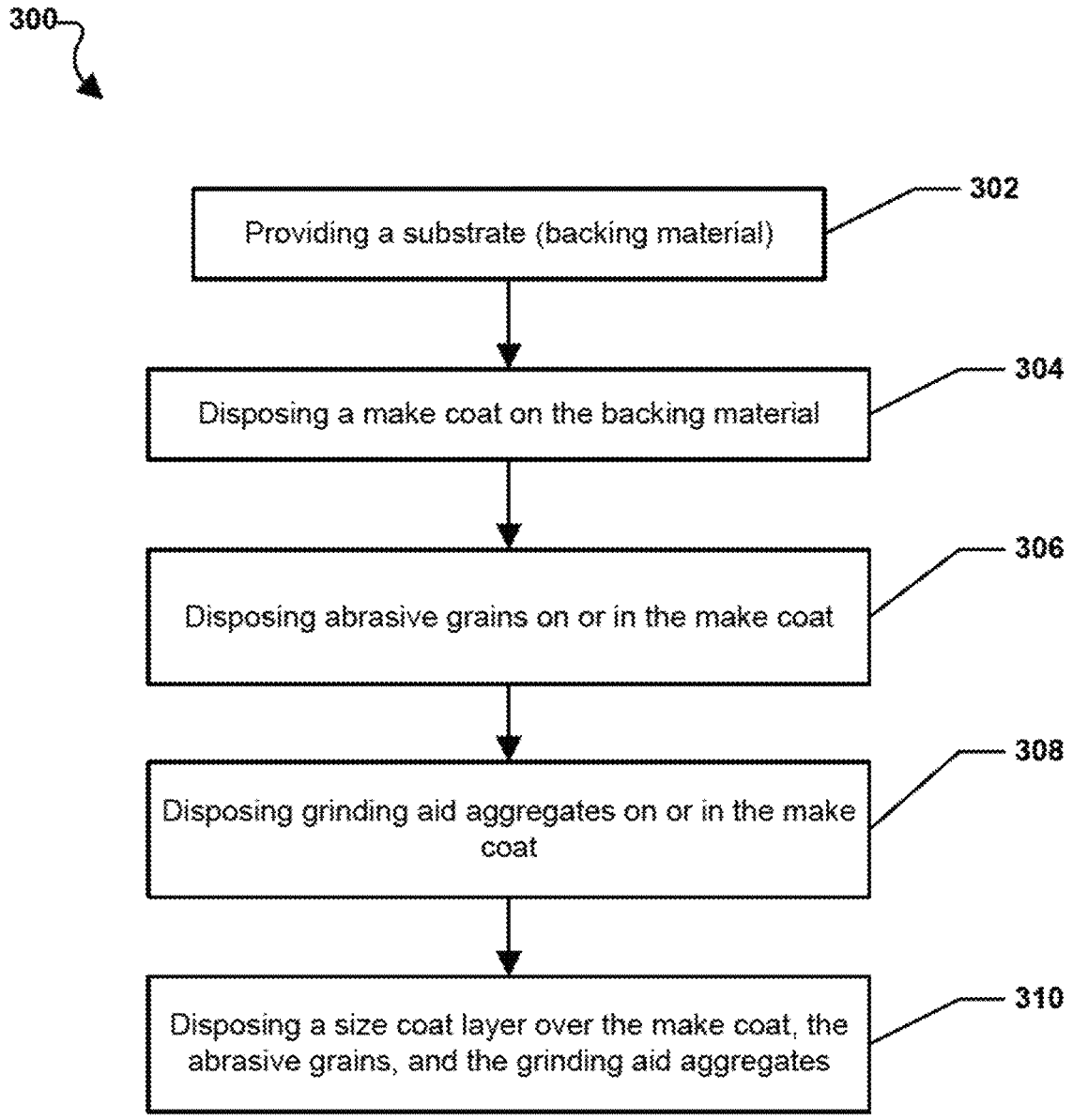
FIG. 3 is an illustration of a flow chart of an embodiment of a method of making a coated abrasive article that includes disposing grinding aid aggregates on or in a make coat.

FIG. 3 is an illustration of a flowchart of an embodiment of a method 300 of making a coated abrasive article containing grinding aid aggregates in a make coat. Step 302 includes providing a substrate (backing material). Step 304 includes disposing a make coat on the backing material. Step 306 includes disposing abrasive grains on or in the make coat. Step 308 includes disposing grinding aid aggregates on or in the make coat. Step 310 includes disposing a size coat over the abrasive grains and the grinding aid aggregates. Optionally, a supersize coat can be applied over the size coat.

Figure 4:
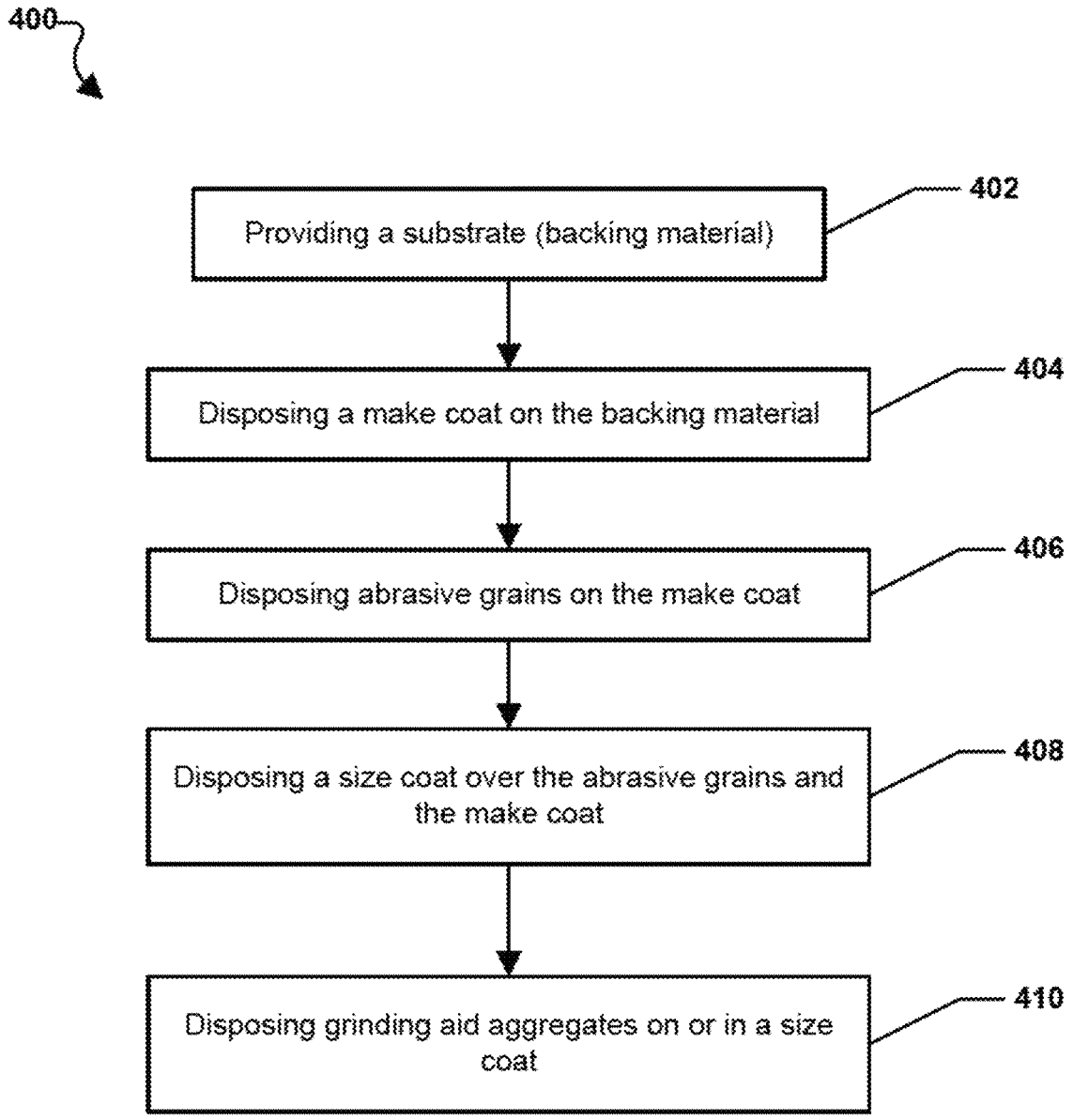
FIG. 4 is an illustration of a flow chart of an embodiment of a method of making a coated abrasive article that includes disposing grinding aid aggregates disposed on or in a size coat.

FIG. 4 is an illustration of a flowchart of an embodiment of a method 400 of making a coated abrasive article containing grinding aid aggregates disposed on or in a size coat. Step 402 includes providing a substrate (backing material). Step 404 includes disposing a make coat on the backing material. Step 406 includes disposing abrasive grains on the make coat. Step 408 includes disposing a size coat over the abrasive grains and the make coat. Step 410 includes disposing grinding aid aggregates on or in the size coat. Optionally, a supersize coat can be applied over the size coat and the grinding aid aggregates.

Aggregates

In an embodiment, a plurality of aggregates is disposed on or in the make coat. In yet another embodiment, a plurality of aggregates is disposed on or in the size coat. In yet another embodiment, a plurality of aggregates is disposed on or in the make coat and on or in the size coat. In an embodiment, the plurality of aggregates can be in the form of a grinding aid aggregate as described herein.

Grinding Aid Aggregates

In an embodiment, a grinding aid aggregate can comprise a polymeric binder and a grinding aid, or a mixture of grinding aids. In an embodiment a grinding aid aggregate can comprise a polymeric binder, a clay component, and a grinding aid, or a mixture of grinding aids.

The amounts of the components of the grinding aid aggregate can vary. In an embodiment, the grinding aid aggregate can comprise:

- 60-99 wt %, such as 85-99 wt %, 90-99 wt %, or 92-99 wt % of a grinding aid; and
- 1-40 wt %, such as 1-15 wt %, 1-10 wt %, or 1-8 wt % of polymeric binder.

In another embodiment, the grinding aid aggregate can comprise:

80-98 wt %, such as 82-97 wt %, 83-96 wt %, 84-95 wt %, 85-94 wt %, 86-93 wt %, or 87-92 wt % of grinding aid;

1-10 wt %, such as 1-8 wt %, 1-7 wt %, 1-6 wt %, 1-5 wt %, or 1-4 wt % of polymeric binder; and 1-10 wt %, such as 2-10 wt %, 3-10 wt %, 4-10 wt %, 5-10 wt %, or 6-10 wt % of a clay component.

In an embodiment, the grinding aid can comprise potassium tetrafluoroborate ($KBF_4$), cryolite ($Na_3AlF_6$), sodium ferrifluoride ($Na_3FeF_6$), sodium hexafluorostrontium ($Na_2SrF_6$), ammonium hexafluorophosphate ($NH_4PF_6$), calcium fluoride ($CaF_2$), calcium phosphate ($Ca_3(PO_4)_2$), magnesium sulfate ($MnSO_4$), lithium carbonate ($Li_2CO_3$), potassium aluminum fluoride ($K_3AlF_6$), or a combination thereof. In an embodiment, the polymeric binder composition can comprise a phenolic polymeric composition, such as a phenolic resole composition; a urea formaldehyde composition; a urethane composition; an epoxy composition; a polyimide composition; a polyamide composition; a polyester composition; an acrylate composition; a latex composition, a rubber composition, such as a styrene-butadiene rubber composition; a protein based composition; a starch based composition, such as a corn starch composition; or any combination thereof. In a specific embodiment, the polymeric binder comprises a phenolic composition, a rubber composition, a starch composition, or a combination thereof. In an embodiment, the clay component can comprise a clay composition, such as a kaolinite clay (e.g., kaolin clay), a smectite clay (e.g., montmorillonite), an illite clay, a chlorite clay, or a combination thereof. In a specific embodiment, the clay component comprises a kaolin clay.

Figure 5:
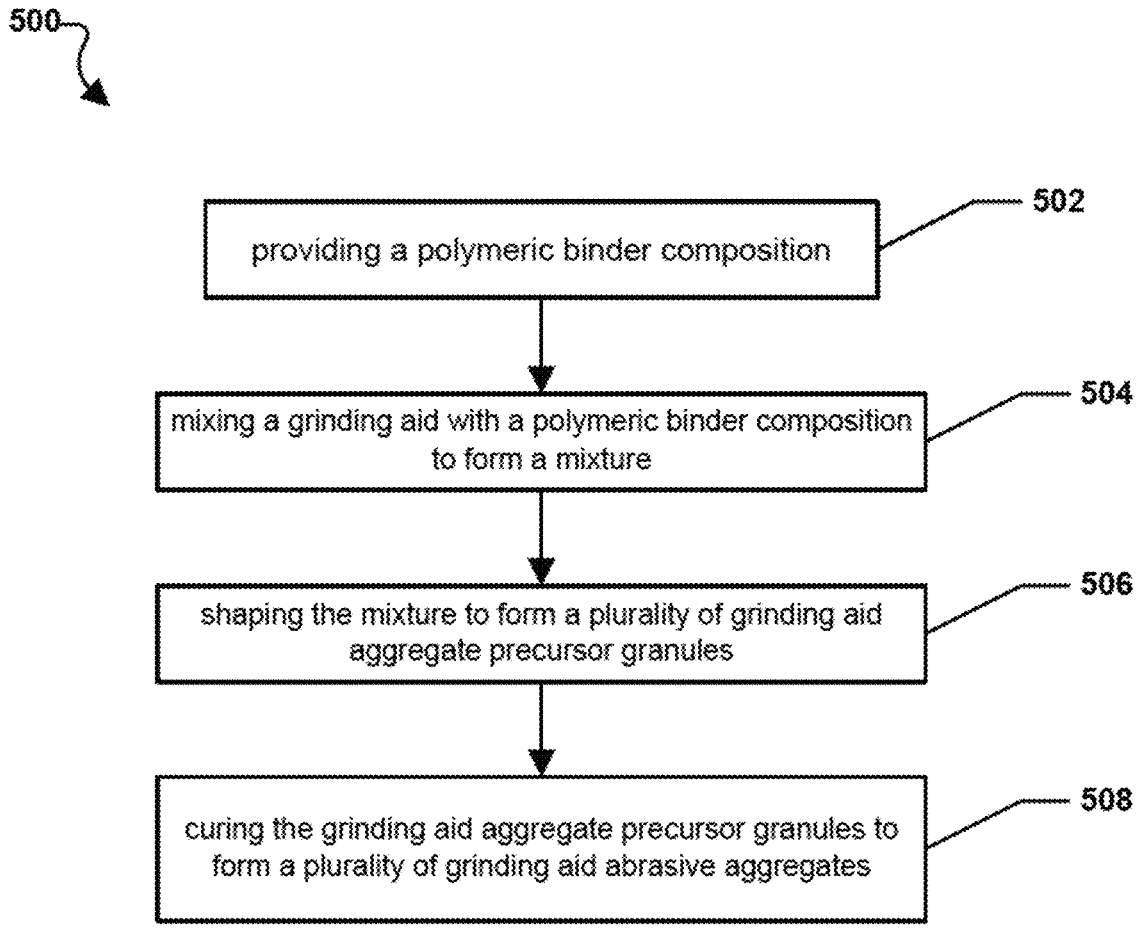
FIG. 5 is a process flow diagram of an embodiment of a method of making an aggregate that includes a grinding aid.

FIG. 5 is a flow diagram of an embodiment of a method 500 of making a grinding aid aggregate. Step 502 includes providing a polymeric binder composition. Step 504 includes mixing a grinding aid with a polymeric binder composition to form a mixture. Step 506 includes shaping the mixture to form a plurality of grinding aid aggregate precursor granules. Shaping of the mixture to form a plurality of abrasive grinding aggregate precursor granules may be accomplished by any means suitable for shaping a wet mixture into granules, including shaping by screening, pressing, sieving, extruding, segmenting, casting, stamping, cutting, or a combination thereof. In particular, the wet mixture may be shaped into the abrasive grinding aggregate precursor granules by pushing, or otherwise moving, the wet mixture through a sieve or screen.

An additional optional activity (not shown), is drying the plurality of aggregate precursor granules. Drying can be performed at temperatures below the expected curing temperature, such as at ambient temperature, to remove water from the mixture but leave the aggregate precursor granules uncured. Dried aggregate precursor granules can be stored for later usage. The dried aggregate precursor granules can then be cured prior to being used or incorporated into a fixed abrasive article. In an embodiment, drying the plurality of shaped aggregate precursor granules is performed.

Step 508 includes curing the grinding aid aggregate precursor granules to form a plurality of grinding aid abrasive aggregates. Curing of the grinding aid aggregate precursor granules can be accomplished by any known suitable methods. Curing can be done under pressure or at ambient pressure. The curing atmosphere can be a reducing atmosphere if desired. In an embodiment, the curing is accomplished by heating in an oven. In another embodiment, the grinding aid aggregates are cured by exposure to a radiation source (infra red and/or UV).

Additional optional activities (not shown), are crushing, sieving, or a combination thereof, of the grinding aid precursor granules prior to curing, and/or of the grinding aid aggregates after curing. In an embodiment, the grinding aid aggregates are crushed and sieved to separate the grinding aid aggregates according to a desired aggregate size distribution.

The amount of the polymeric binder composition in a grinding aid aggregate can vary. In an embodiment, the polymeric binder comprises at least 1 wt %, such as at least 2 wt %, at least 3 wt %, at least 4 wt %, at least 5 wt %, at least 7 wt %, at least 10 wt %, or at least 15 wt % of the grinding aid aggregate. In another embodiment, the polymeric binder comprises not greater than 40 wt % of the grinding aid aggregate, such as not greater than 35 wt %, not greater than 30 wt %, not greater than 25 wt %, not greater than 20 wt %, not greater than 15 wt %, not greater than 10 wt %, not greater than 5 wt %, or not greater than 4 wt % of the grinding aid aggregate. The amount of the polymeric binder composition can be within a range of any minimum or maximum value noted above. In a specific embodiment, the amount of the aggregate binder composition comprises from at least 1 wt % to not greater than 40 wt % of the grinding aid aggregate.

The amount of grinding aid in a grinding aid aggregate can vary. In an embodiment, the grinding aid can comprise at least 60 wt % of the grinding aid aggregate, such as at least 65 wt % of the grinding aid aggregate, such as at least 70 wt %, at least 75 wt %, at least 80 wt %, at least 85 wt %, or at least 90 wt % of the grinding aid aggregate. In another embodiment, the grinding aid comprises not greater than 99 wt % of the grinding aid aggregate, such as not greater than 98 wt %, not greater than 97 wt %, not greater than 96 wt %, not greater than 95 wt %, not greater than 90 wt %, or not greater than 85 wt % of the grinding aid aggregate. The amount of the grinding aid can be within a range of any minimum or maximum value noted above. In a specific embodiment, the amount of the grinding aid comprises from at least at least 60 wt % to not greater than 99 wt %, such as 85-99 wt %, 90-99 wt %, or 92-99 wt % of the grinding aid aggregate.

Abrasive Particles

Abrasive particles can include essentially single phase inorganic materials, such as alumina, silicon carbide, silica, ceria, and harder, high performance superabrasive particles such as cubic boron nitride and diamond. Additionally, the abrasive particles can include composite particulate materials. The abrasive particles can be doped abrasive particles, undoped abrasive particles, or a combination thereof. Such materials can include aggregates, which can be formed through slurry processing pathways that include removal of the liquid carrier through volatilization or evaporation, leaving behind unfired ("green") aggregates, that can optionally undergo high temperature treatment (i.e., firing, sintering) to form usable, fired aggregates. Further, the abrasive regions can include engineered abrasives including macrostructures and particular three-dimensional structures.

In an embodiment, the abrasive particles are blended with the binder formulation to form abrasive slurry. Alternatively, the abrasive particles are applied over the binder formulation after the binder formulation is coated on the backing. Optionally, a functional powder can be applied over the abrasive regions to prevent the abrasive regions from sticking to a patterning tooling. Alternatively, patterns can be formed in the abrasive regions absent the functional powder.

The abrasive particles can be formed of any one of or a combination of abrasive particles, including silica, alumina (fused or sintered), alumina (ceramic, sol-gel), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery. For example, the abrasive particles can be selected from a group consisting of silica, alumina, zirconia, silicon carbide, silicon nitride, boron nitride, garnet, diamond, co-fused alumina zirconia, ceria, titanium diboride, boron carbide, flint, emery, alumina nitride, and a blend thereof. Particular embodiments have been created by use of dense abrasive particles comprised principally of alpha-alumina.

The abrasive grain can also have a particular shape. An example of such a shape includes a rod, a triangle, a pyramid, a cone, a solid sphere, a hollow sphere, or the like. Alternatively, the abrasive grain can be randomly shaped.

Weight of Abrasives

In a particular embodiment, the abrasive particles and grinding aid aggregates may comprise a particular weight. In a particular embodiment, the abrasive particles may comprise at least about 80 wt % of the total weight of the abrasive particles and grinding aid aggregates. In still another embodiment, the grinding aid aggregates may comprise at least about 1 wt % of the total weight of the abrasive particles and grinding aid aggregates.

In an embodiment, the abrasive particles may comprise at least about 80 wt %, such as at least about 82 wt % or at least about 85 wt % or at least about 87 wt % or even at least about 90 wt % of the total weight of the abrasive particles and grinding aid aggregates. In still other embodiments, the abrasive particles may comprise not greater than about 99 wt %, such as not greater than about 98 wt % or not greater than about 97 wt % or not greater than about 96 wt % or even not greater than 95 wt % of the total weight of the abrasive particles and grinding aid aggregates. It will be appreciated that the abrasive particles may comprise a wt % of the total weight of the abrasive particles and grinding aid aggregates in a range between any of the minimum and maximum values noted above.

In an embodiment, the grinding aid aggregates may comprise at least about 1 wt %, such as at least about 2 wt % or at least about 5 wt % or at least about 7 wt % or even at least about 10 wt % of the total weight of the abrasive particles and grinding aid aggregates. In still other embodiments, the grinding aid aggregates may comprise not greater than about 20 wt %, such as not greater than about 18 wt % or not greater than about 15 wt % or not greater than about 13 wt % or even not greater than 11 wt % of the total weight of the abrasive particles and grinding aid aggregates. It will be appreciated that the grinding aid aggregates may comprise a wt % of the total weight of the abrasive particles and grinding aid aggregates in a range between any of the minimum and maximum values noted above.

In a particular embodiment, the grinding aid aggregates can be disposed among and between the abrasive particles. In still another embodiment, the grinding aid aggregates can be disposed above the abrasive particles. In still other embodiments, the grinding aid aggregates can be disposed among and between the abrasive particles, above the abrasive particles, or a combination thereof.

Cross-Sectional Area of Abrasive Particles and Aggregates

Figure 6:
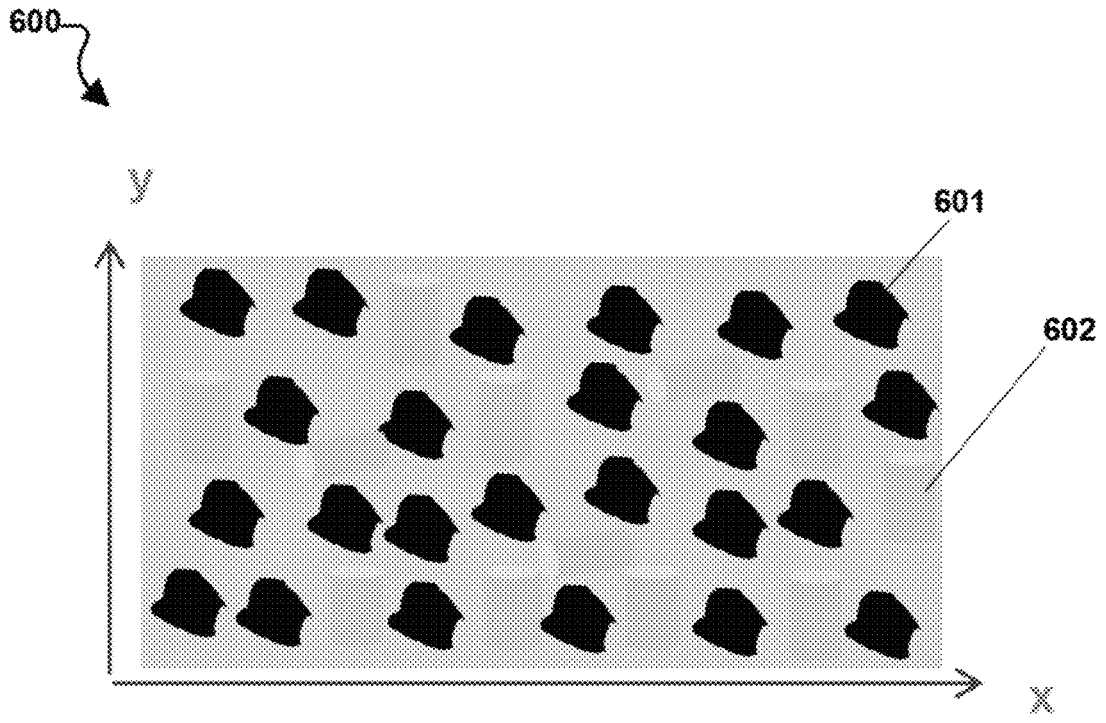
FIG. 6 is a top-down illustration of an embodiment of a coated abrasive article that includes grinding aid aggregates.

In a particular embodiment, the abrasive particles and grinding aid aggregates can be distributed on a coated abrasive article in such a way to facilitate improved performance. FIG. 6 illustrates a top-down illustration of coated abrasive article 600 having a plurality of abrasive particles 601 and a plurality of grinding aid aggregates 602. In a particular embodiment, the coated abrasive article 600 may have a ratio $A_{ABR}/A_{GAA}$, wherein $A_{GAA}$ is a total cross-sectional area of the plurality of grinding aid aggregates 602 and $A_{ABR}$ is a total cross-sectional area of the plurality of abrasive particles 601. In accordance with an embodiment, the coated abrasive article 600 may have a ratio $A_{ABR}/A_{GAA}$ of at least about 1, such as at least about 2 or at least about 3 or at least about 4 or at least about 5 or even at least about 10. In still other embodiments, the coated abrasive article 600 may have a ratio $A_{ABR}/A_{GAA}$ of not greater than 1000, such as not greater than 500 or not greater than about 100 or not greater than about 50 or even not greater than about 40. It will be appreciated that the coated abrasive article 600 may have a ratio $A_{ABR}/A_{GAA}$ in a range between any of the minimum and maximum values noted above.

Height of Abrasive Particles and Aggregates

Figure 7:
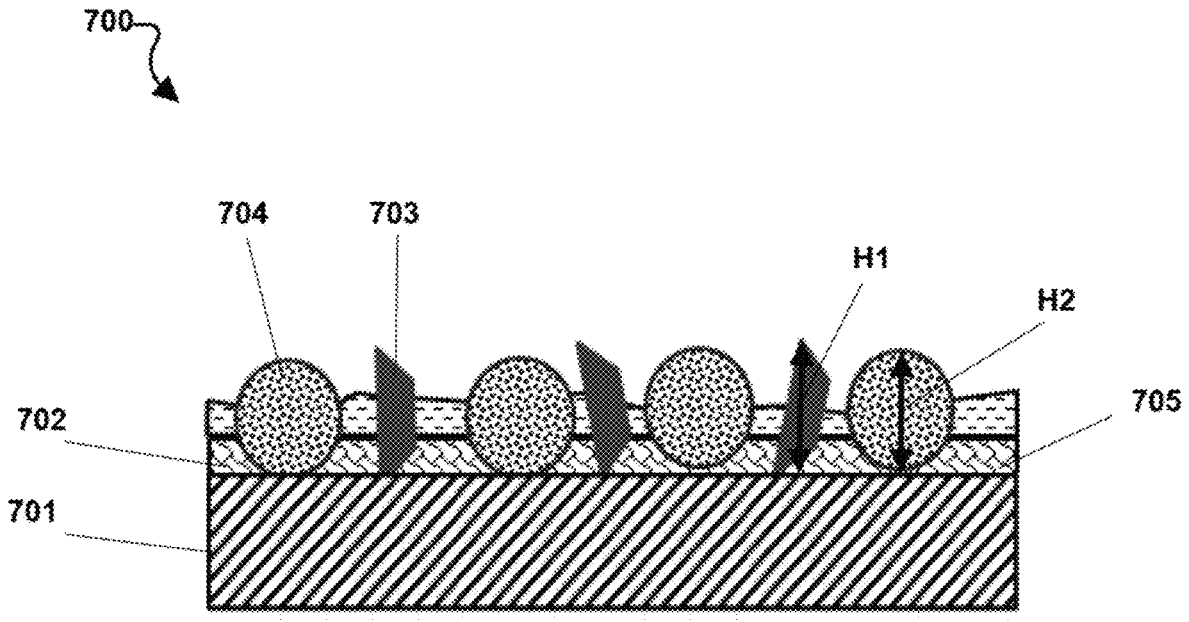
FIG. 7 is a cross-section illustration of an embodiment of a coated abrasive article that includes grinding aid aggregates.

In a particular embodiment, the shaped abrasive particles and grinding aid aggregates may have a particular height which may facilitate improved performance. FIG. 7 includes a cross-sectional illustration of a coated abrasive article 700. The coated abrasive article 700 includes a substrate 701, a make coat 702, abrasive particles 703 and grinding aid aggregates 704.

In a particular embodiment, the abrasive particles 703 of the coated abrasive article 700 may have a particular height H1 perpendicular to a surface 705 of the substrate 701 of the coated abrasive article 700. In accordance with an embodiment, the abrasive particles 703 can have a height H1 of at least about 0.05 mm, such as at least about 0.1 mm or at least about 0.2 mm or at least about 0.3 mm or at least about 0.4 mm or at least about 0.5 mm or at least about 0.6 mm or even at least about 0.7 mm. In still other embodiments, the abrasive particles 703 can have a height H1 of not greater than 100 mm, such as not greater than 50 mm, or not greater than 25 mm or not greater than 20 mm or not greater than 10 mm or not greater than 5 mm or not greater than 1 mm or even not greater than 0.8 mm. It will be appreciated that the abrasive particles 703 can have a height H1 in a range between any of the minimum and maximum values noted above.

In still another embodiment, the abrasive particles 703 of the coated abrasive article 700 may have an average particle height ($H_{ABR}$), wherein the average particle height ($H_{ABR}$) is the average height of all abrasive particles 703 of the coated abrasive article 700. In accordance with an embodiment, the abrasive particles 703 can have an average particle height ($H_{ABR}$) of at least about 0.05 mm, such as at least about 0.1 mm or at least about 0.2 mm or at least about 0.3 mm or at least about 0.4 mm or at least about 0.5 mm or at least about 0.6 mm or even at least about 0.7 mm. In still other embodiments, the abrasive particles 703 can have an average particle height ($H_{ABR}$) of not greater than 100 mm, such as not greater than 50 mm, or not greater than 25 mm or not greater than 20 mm or not greater than 10 mm or not greater than 5 mm or not greater than 1 mm or even not greater than 0.8 mm. It will be appreciated that the abrasive particles 703 can have an average particle height ($H_{ABR}$) in a range between any of the minimum and maximum values noted above.

In a particular embodiment, the grinding aid aggregates 704 of the coated abrasive article 700 may have a particular height H2 perpendicular to a surface 705 of the substrate 701 of the coated abrasive article 700. In accordance with an embodiment, the grinding aid aggregates 704 can have a height H2 of at least about 0.05 mm, such as at least about 0.1 mm or at least about 0.2 mm or at least about 0.3 mm or at least about 0.4 mm or at least about 0.5 mm or at least about 0.6 mm or at least about 0.7 mm or at least about 0.8 mm or at least about 0.9 mm or even at least about 1 mm. In still other embodiments, the grinding aid aggregates 704 can have a height H2 of not greater than 100 mm, such as not greater than 50 mm, or not greater than 25 mm or not greater than 20 mm or not greater than 10 mm or not greater than 5 mm or not greater than 3 mm or not greater than 2 even not greater than 1.7 mm. It will be appreciated that the grinding aid aggregates 704 can have a height H2 in a range between any of the minimum and maximum values noted above.

In a particular embodiment, the grinding aid aggregates 704 of the coated abrasive article 700 may have an average particle height ($H_{GAA}$), wherein the average particle height ($H_{GAA}$) is the average height all grinding aid aggregates 704 of the coated abrasive article 700. In accordance with an embodiment, the grinding aid aggregates 704 can have an average particle height ($H_{GAA}$) of at least about 0.05 mm, such as at least about 0.1 mm or at least about 0.2 mm or at least about 0.3 mm or at least about 0.4 mm or at least about 0.5 mm or at least about 0.6 mm or at least about 0.7 mm or at least about 0.8 mm or at least about 0.9 mm or even at least about 1 mm. In still other embodiments, the grinding aid aggregates 704 can have an average particle height ($H_{GAA}$) of not greater than 100 mm, such as not greater than 50 mm, or not greater than 25 mm or not greater than 20 mm or not greater than 10 mm or not greater than 5 mm or not greater than 3 mm or not greater than 2 even not greater than 1.7 mm. It will be appreciated that the grinding aid aggregates 704 can have an average particle height ($H_{GAA}$) in a range between any of the minimum and maximum values noted above.

In a particular embodiment, the coated abrasive article 700 can have a particular ratio ($H_{GAA}/H_{ABR}$) of at least about 0.5. In accordance with an embodiment, the coated abrasive article 700 can have a ratio of $H_{GAA}/H_{ABR}$ of at least about 0.5, such as at least about 0.6 or at least about 0.7 or at least about 0.8 or at least about 0.9 or at least about 1 or at least about 1.1 or at least about 1.2 or at least about 1.3 or at least about 1.4 or even at least about 1.5. In still other embodiments, the coated abrasive article 700 can have a ratio of $H_{GAA}/H_{ABR}$ not greater than about 15, such as not greater than about 10 or not greater than about 5 or not greater than about 3 or even not greater than about 2. It will be appreciated that the coated abrasive article 700 can have a ratio of $H_{GAA}/H_{ABR}$ in a range between any of the minimum and maximum values noted above.

In a particular embodiment, the particle size of the abrasive particles is typically specified to be the longest dimension of the abrasive particle. In a particular embodiment, the abrasive particles may have a particle size corresponding to the height H1, as described above. It will be appreciated that the abrasive particles may have a particle size corresponding to any of the heights H1 as noted above. In a particular embodiment, the grinding aid aggregates may have a particle size corresponding to the height H2, as described above. It will be appreciated that the grinding aid aggregates may have a particle size corresponding to any of the heights H2 as noted above.

In a particular embodiment, the abrasive particles may have a particle size that is independent from size H1. In a particular embodiment, the grinding aid aggregates may have a particle size independent from size H2.

In accordance with an embodiment, the abrasive particles 703 can have an abrasive particle size, such as an average abrasive particle size, of at least about 0.02 mm, such as at least about 0.03 mm, at least about 0.05 mm, at least about 0.1 mm, at least about 0.15 mm, at least about 0.2 mm, at least about 0.25 mm, at least about 0.3 mm, at least about 0.35 mm, at least about 0.4 mm, at least about 0.45 mm, at least about 0.5 mm, or at least about 0.55 mm. In an embodiment, the abrasive particles 703 can have an abrasive particle size of not greater than 100 mm, such as not greater than 50 mm, or not greater than 25 mm or not greater than 20 mm or not greater than 10 mm or not greater than 5 mm or not greater than 1 mm or even not greater than 0.8 mm. It will be appreciated that the abrasive particles 703 can have an abrasive particle size in a range between any of the minimum and maximum values noted above.

In a particular embodiment, the grinding aid aggregates 704 of the coated abrasive article 700 may have a particular aggregate size, such as an average aggregate size, of at least about 0.02 mm, such as at least about 0.03 mm, at least about 0.05 mm, at least about 0.1 mm, at least about 0.2 mm, at least about 0.3 mm, at least about 0.4 mm, at least about 0.5 mm, at least about 0.6 mm, at least about 0.7 mm, at least about 0.8 mm, at least about 0.9 mm, or at least about 1 mm. In an embodiment, the grinding aid aggregates 704 can have an aggregate size not greater than 100 mm, such as not greater than 50 mm, not greater than 25 mm, not greater than 20 mm, not greater than 10 mm, not greater than 5 mm, not greater than 3 mm, not greater than 2 mm, or not greater than 1.7 mm. It will be appreciated that the grinding aid aggregates 704 can have an aggregate size in a range between any of the minimum and maximum values noted above.

In a particular embodiment, the grinding aid aggregates 704 of the coated abrasive article 700 may have an average particle size of at least about 0.02 mm to not greater than 10 mm, such as at least about 0.2 mm to not greater than 5 mm, or at least about 0.5 mm to not greater than 3 mm.

Backing Material

The backing material (also referred to herein as "a backing" or "substrate") can be flexible or rigid. The backing can be made of any number of various materials including those conventionally used as backings in the manufacture of coated abrasives. An exemplary flexible backing includes a polymeric film (for example, a primed film), such as polyolefin film (e.g., polypropylene including biaxially oriented polypropylene), polyester film (e.g., polyethylene terephthalate), polyamide film, or cellulose ester film; metal foil; mesh; foam (e.g., natural sponge material or polyurethane foam); cloth (e.g., cloth made from fibers or yarns comprising polyester, nylon, silk, cotton, poly-cotton, rayon, or combinations thereof); paper; vulcanized paper; vulcanized rubber; vulcanized fiber; nonwoven materials; a combination thereof; or a treated version thereof. Cloth backings can be woven or stitch bonded. In particular examples, the backing is selected from the group consisting of paper, polymer film, cloth (e.g., cotton, poly-cotton, rayon, polyester, poly-nylon), vulcanized rubber, vulcanized fiber, metal foil and a combination thereof. In other examples, the backing includes polypropylene film or polyethylene terephthalate (PET) film. In other embodiments, the backing material is a paper backing. The paper can be a single ply paper or a multi-ply paper, such as a laminate paper. The paper can be saturated or unsaturated.

The backing can optionally have at least one of a saturant, a presize layer (also called a "front fill layer"), or a backsize layer (also called a "back fill layer"). The purpose of these layers is typically to seal the backing or to protect yarn or fibers in the backing. If the backing is a cloth material, at least one of these layers is typically used. The addition of the presize layer or backsize layer can additionally result in a "smoother" surface on either the front or the back side of the backing. Other optional layers known in the art can also be used such as a tie layer.

The backing can be a fibrous reinforced thermoplastic such as described, for example, in U.S. Pat. No. 5,417,726 (Stout et al.), or an endless spliceless belt, as described, for example, in U.S. Pat. No. 5,573,619 (Benedict et al.). Likewise, the backing can be a polymeric substrate having hooking stems projecting therefrom such as that described, for example, in U.S. Pat. No. 5,505,747 (Chesley et al.). Similarly, the backing can be a loop fabric such as that described, for example, in U.S. Pat. No. 5,565,011 (Follett et al.).

Abrasive Layer

The abrasive layer comprises a plurality of abrasive particles disposed on, or dispersed in, a polymeric binder composition (commonly known as a make coat). In an embodiment, an abrasive layer includes abrasive particles disposed on, or dispersed in, a binder composition. In an embodiment, the abrasive layer can include a further polymeric composition (commonly known as a size coat) disposed over the make coat. In an embodiment, an abrasive layer includes abrasive particles and grinding aid aggregates disposed on, or dispersed in, a binder composition.

Make Coat—Binder Composition

The binder composition (commonly known as the make coat) can be formed of a single polymer or a blend of polymers. The binder composition can be formed from an epoxy composition, acrylic composition, a phenolic composition, a polyurethane composition, a phenolic composition, a polysiloxane composition, or combinations thereof. In addition, the binder composition can include tribological performance enhancing composition, as described above, additives, or a combination thereof. In addition, the binder composition can include active filler particles, additives, or a combination thereof, as described herein.

The binder composition generally includes a polymer matrix, which binds abrasive particles to the backing or to a compliant coat, if such a compliant coat is present. Typically, the binder composition is formed of cured binder formulation. In an embodiment, the binder formulation includes a polymer component and a dispersed phase.

The binder formulation can include one or more reaction constituents or polymer constituents for the preparation of a polymer. A polymer constituent can include a monomeric molecule, a polymeric molecule, or a combination thereof. The binder formulation can further comprise components selected from the group consisting of solvents, plasticizers, chain transfer agents, catalysts, stabilizers, dispersants, curing agents, reaction mediators and agents for influencing the fluidity of the dispersion.

The polymer constituents can form thermoplastics or thermosets. By way of example, the polymer constituents can include monomers and resins for the formation of polyurethane, polyurea, polymerized epoxy, polyester, polyimide, polysiloxanes (silicones), polymerized alkyd, styrene-butadiene rubber, acrylonitrile-butadiene rubber, polybutadiene, or, in general, reactive resins for the production of thermoset polymers. Another example includes an acrylate or a methacrylate polymer constituent. The precursor polymer constituents are typically curable organic material (i.e., a polymer monomer or material capable of polymerizing or crosslinking upon exposure to heat or other sources of energy, such as electron beam, ultraviolet light, visible light, etc., or with time upon the addition of a chemical catalyst, moisture, or other agent which cause the polymer to cure or polymerize). A precursor polymer constituent example includes a reactive constituent for the formation of an amino polymer or an aminoplast polymer, such as alkylated urea-formaldehyde polymer, melamine-formaldehyde polymer, and alkylated benzoguanamine-formaldehyde polymer; acrylate polymer including acrylate and methacrylate polymer, alkyl acrylate, acrylated epoxy, acrylated urethane, acrylated polyester, acrylated polyether, vinyl ether, acrylated oil, or acrylated silicone; alkyd polymer such as urethane alkyd polymer; polyester polymer; reactive urethane polymer; phenolic polymer such as resole and novolac polymer; phenolic/latex polymer; epoxy polymer such as bisphenol epoxy polymer; isocyanate; isocyanurate; polysiloxane polymer including alkylalkoxysilane polymer; or reactive vinyl polymer. The binder formulation can include a monomer, an oligomer, a polymer, or a combination thereof. In a particular embodiment, the binder formulation includes monomers of at least two types of polymers that when cured can crosslink. For example, the binder formulation can include epoxy constituents and acrylic constituents that when cured form an epoxy/acrylic polymer.

Size Coat

The coated abrasive article can comprise a size coat disposed on the abrasive layer. The size coat can be the same as or different from the polymer binder composition used to form the size coat of the abrasive layer. The size coat can comprise any conventional compositions known in the art that can be used as a size coat. The size coat can include one or more additives. In a particular embodiment, the size coat can comprise grinding aid aggregates disposed on, or dispersed in the polymer binder composition.

Supersize Coat

The coated abrasive article can comprise a supersize coat disposed on the size coat. The supersize coat can be the same as or different from the polymer binder composition of the binder composition of the make coat. In a specific embodiment, the supersize coat can comprise comprises an acetate composition, such as polyvinyl acetate; a phenolic polymeric composition, such as a phenolic resole composition; a urea formaldehyde composition; a melamine composition; a urethane composition; an epoxy composition; a polyimide composition; a polyamide composition; a polyester composition; an acrylate composition, such as a UV curable acrylate composition, or a zinc cross-linked acrylic composition; a rubber composition, such as a styrene butadiene rubber; a protein based composition; a starch based composition, or a combination thereof. In a particular embodiment, the supersize coat composition comprises a grinding aid, as described above. In yet another embodiment, the supersize coat composition comprises an anti-loading composition. In still other embodiments, the supersize coat comprises a mixture of polymeric binder composition and a grinding aid composition, an anti-loading composition, or a combination thereof. The amounts of the components of the supersize coat can vary. In an embodiment, the supersize coat can comprise:

75-99 wt % of the grinding aid composition, an anti-loading composition, or a combination thereof; and 1-25 wt % of the polymeric binder composition.

In still other embodiments, the supersize coat can comprise grinding aid aggregates disposed on, or dispersed in the polymeric binder composition.

Additives

The make coat, size coat, or supersize coat can include one or more additives. Suitable additives can include grinding aids, fibers, lubricants, wetting agents, thixotropic materials, surfactants, thickening agents, pigments, dyes, antistatic agents, coupling agents, plasticizers, suspending agents, pH modifiers, adhesion promoters, lubricants, bactericides, fungicides, flame retardants, degassing agents, anti-dusting agents, dual function materials, initiators, chain transfer agents, stabilizers, dispersants, reaction mediators, colorants, and defoamers. The amounts of these additive materials can be selected to provide the properties desired. These optional additives can be present in any part of the overall system of the coated abrasive product according to embodiments of the present disclosure. Suitable grinding aids can be inorganic based; such as halide salts, for example cryolite, wollastonite, and potassium fluoroborate; or organic based, such as sodium lauryl sulphate, or chlorinated waxes, such as polyvinyl chloride. In an embodiment, the grinding aid can be an environmentally sustainable material.

EMBODIMENTS LISTING

Embodiment 1

A coated abrasive article comprising:

a backing substrate;

a polymeric make coat binder composition disposed on the backing substrate;

a plurality of abrasive particles disposed on or in the make coat binder composition;

a polymeric size coat composition disposed over the make coat composition; and a plurality of grinding aid aggregates comprising a mixture of polymeric binder composition and a grinding aid composition, wherein the grinding aid aggregates are disposed on the make coat composition, on the size coat composition, or a combination thereof.

Embodiment 2

The coated abrasive article of embodiment 1, wherein the grinding aid composition comprises potassium tetrafluoroborate ($KBF_4$), cryolite ($Na_3AlF_6$), sodium ferrifluoride ($Na_3FeF_6$), sodium hexafluorostrontium ($Na_2SrF_6$), ammonium hexafluorophosphate ($NH_4PF_6$), calcium fluoride ($CaF_2$), calcium phosphate ($Ca_3(PO_4)_2$), magnesium sulfate ($MnSO_4$), lithium carbonate ($Li_2CO_3$), potassium aluminum fluoride ($K_3AlF_6$), or a combination thereof.

Embodiment 3

The coated abrasive article of embodiment 2, wherein the grinding aid aggregate comprises:

60-99 wt % of grinding aid composition thereof; and 1-40 wt % of the polymeric binder composition.

Embodiment 4

The coated abrasive of embodiment 3, wherein the grinding aid aggregates are disposed on the make coat composition.

Embodiment 5

The coated abrasive of embodiment 3, wherein the grinding aid aggregates are disposed on the size coat composition.

Embodiment 6

The coated abrasive of embodiment 3 wherein the grinding aid aggregates are disposed on the make coat composition and on the size coat composition.

Embodiment 7

The coated abrasive of embodiment 4, wherein the plurality of grinding aid aggregates are disposed among and between the abrasive particles.

Embodiment 8

The coated abrasive of embodiment 5, wherein the plurality of grinding aid aggregates are disposed among and between the abrasive particles.

Embodiment 9

The coated abrasive of embodiment 6, wherein the plurality of grinding aid aggregates are disposed among and between the abrasive particles, above the abrasive particles, or a combination thereof.

Embodiment 10

The coated abrasive article of embodiment 3, wherein the plurality of grinding aid aggregates are disposed to have an average particle height ($H_{GAA.}$), wherein the plurality of abrasive particles are disposed to have an average particle height ($H_{ABR}$.), and wherein the ratio of $H_{GAA}/H_{ABR.}$ ranges from 0.5 to 10, such as 1 to 5, such as 1.5 to 2.8.

Embodiment 11

The coated abrasive article of embodiment 3, wherein the grinding aid aggregates have a particle size ranging from 0.1 mm to 5 mm, such as 0.3 mm to 1.7 mm, such a 0.7 mm to 1.4 mm.

Embodiment 12

The coated abrasive article of embodiment 11, wherein the abrasive particles have an average particle size ranging from 0.1 mm to 5 mm, such as 0.1 mm to 2.5 mm, such as 0.1 mm to 0.8 mm.

Embodiment 13

The coated abrasive article of embodiment 3, wherein the plurality of grinding aid aggregates have a total cross-sectional area ($A_{GAA.}$), wherein the plurality of abrasive particles have an a total cross-sectional area ($A_{ABR.}$), and wherein the ratio of $A_{ABR}/A_{GAA}$ ranges from 1 to 1000, such as 10 to 100.

Embodiment 14

The coated abrasive article of embodiment 3, wherein the total weight of the grinding aid aggregates and the abrasive particles comprises:

80-99 wt % of the abrasive particles; and
1-20 wt % of the grinding aid aggregates.

Embodiment 15

The coated abrasive of embodiment 3, wherein the grinding aid aggregate polymeric binder composition comprises a phenolic polymeric composition, such as a phenolic resole composition; a urea formaldehyde composition; a urethane composition; an epoxy composition; a polyimide composition; a polyamide composition; a polyester composition; an acrylate composition, a protein based composition, a starch based composition, or any combination thereof.

Embodiment 16

The coated abrasive of embodiment 15, further comprising a supersize coat composition disposed over the size coat.

Embodiment 17

The coated abrasive of embodiment 16, wherein the supersize coat comprises a mixture of polymeric binder composition and a grinding aid composition, an anti-loading composition, or a combination thereof.

Embodiment 18

The coated abrasive of embodiment 17, wherein the supersize coat composition comprises:
75-99 wt % of the grinding aid composition, an anti-loading composition, or a combination thereof; and
1-25 wt % of the polymeric binder composition.

Embodiment 19

The coated abrasive of embodiment 17, wherein the grinding aid comprises potassium tetrafluoroborate ($KBF_4$), cryolite ($Na_3AlF_6$), sodium ferrifluoride ($Na_3FeF_6$), sodium hexafluorostrontium ($Na_2SrF_6$), ammonium hexafluorophosphate ($NH_4PF_6$), calcium fluoride ($CaF_2$), calcium phosphate ($Ca_3(PO_4)_2$), magnesium sulfate ($MnSO_4$), lithium carbonate ($Li_2CO_3$), potassium aluminum fluoride ($K_3AlF_6$), or a combination thereof.

Embodiment 20

The coated abrasive of embodiment 17, wherein the polymeric binder composition comprises an acetate composition, such as polyvinyl acetate; a phenolic polymeric composition, such as a phenolic resole composition; a urea formaldehyde composition; melamine resin composition; a urethane composition; an epoxy composition; a polyimide composition; a polyamide composition; a polyester composition; an acrylate composition, such as a UV curable acrylate, or a zinc cross-linked acrylic composition; a rubber composition, such as a styrene butadiene rubber; a protein based composition; a starch based composition, or a combination thereof.

EXAMPLES

Example 1: Discs—Abrasive Performance Testing S1-S2—A36 Hot Rolled Steel

Figure 8:
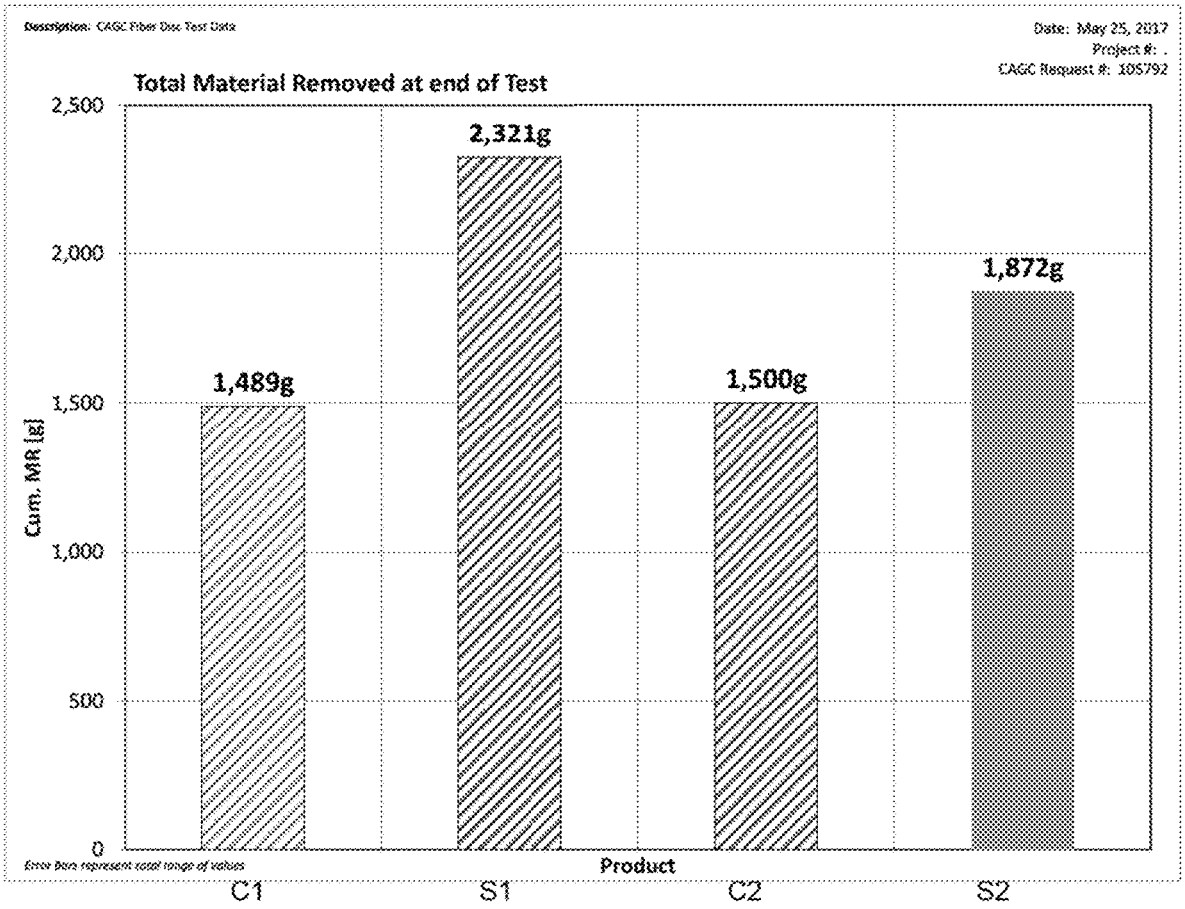
FIG. 8 is a bar graph showing cumulative material removal by inventive abrasive disc embodiments compared to conventional abrasive discs.
Figure 9:
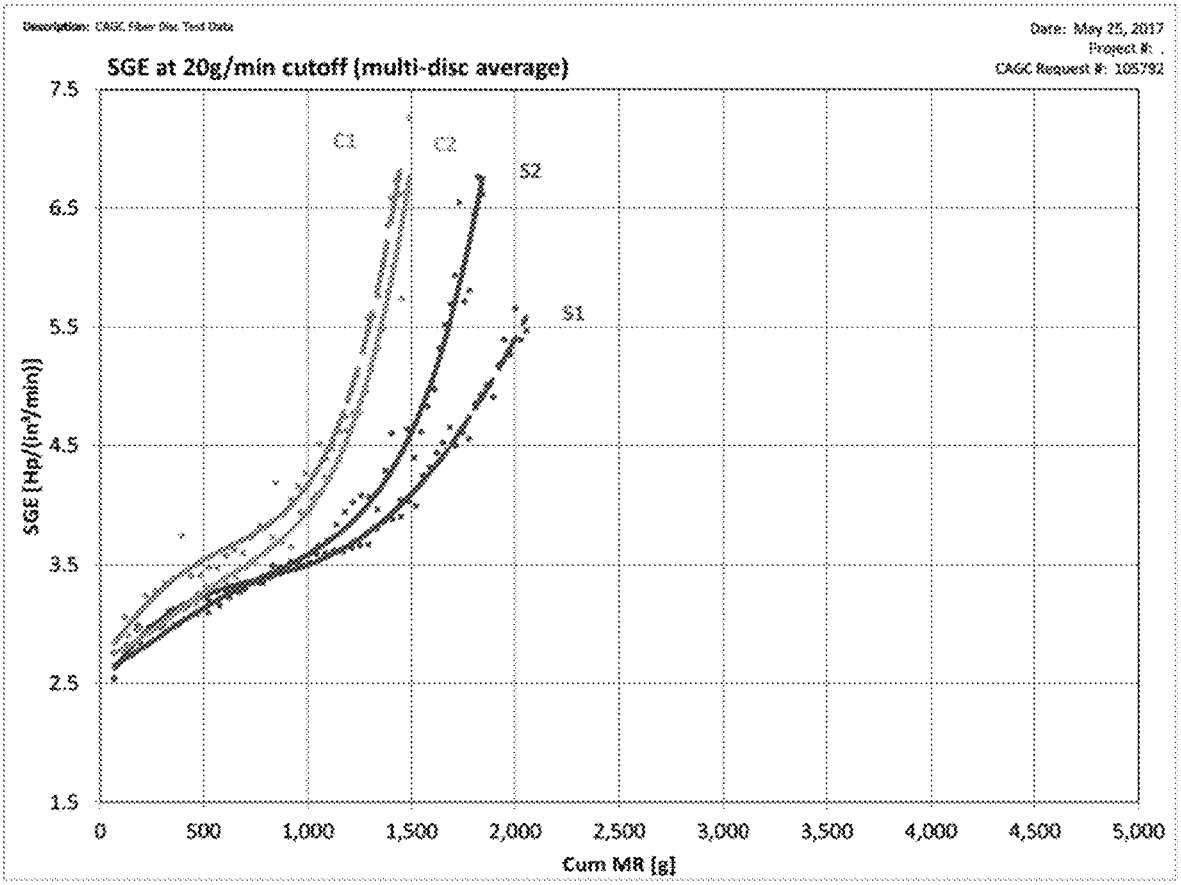
FIG. 9 is a graph showing specific grinding energy ("SGE") versus cumulative material removal by inventive abrasive disc embodiments compared to conventional abrasive discs.

Inventive abrasive discs were successfully prepared that included grinding aid aggregates disposed on a size coat. The grinding aid aggregates included $KBF_4$ as the grinding aid. The grinding aid aggregates varied in size (avg. height) from 0.75 mm to 1.7 mm. Abrasive performance testing of the inventive discs and conventional comparative discs was conducted on A36 Hot Rolled Steel. The comparative discs did not have grinding aid aggregates on a size coat and were used as a control sample. The construction of the abrasive discs and the abrasive performance results are shown in Table 1. The results indicated increased performance for S1 and S2. Cumulative material removed was graphed and is shown in FIG. 8. Specific grinding energy ("SGE") was measured during testing and is graphed compared to cumulative material removed as shown in FIG. 9.

TABLE 1

Abrasive Performance S1-S2 on A36 Hot Rolled Steel

| Sample | Make Coat | Abrasive Grain size | Size Coat | Avg. Cum. Cut (As a % of C1) |
|---|---|---|---|---|
| C1 | Control | 24 grit (0.75 mm) | Control | 100% |
| S1 | Control | 24 grit (0.75 mm) | Control; $KBF_4$ aggregates on size | 156% |
| C2 | Control | 30 grit (0.6 mm) | Control | 100% |
| S2 | Control | 30 grit (0.6 mm) | Control; $KBF_4$ aggregates on size | 125% |

Example 2: Discs—Abrasive Performance Testing S3-S4—A36 Hot Rolled Steel

Figure 10:
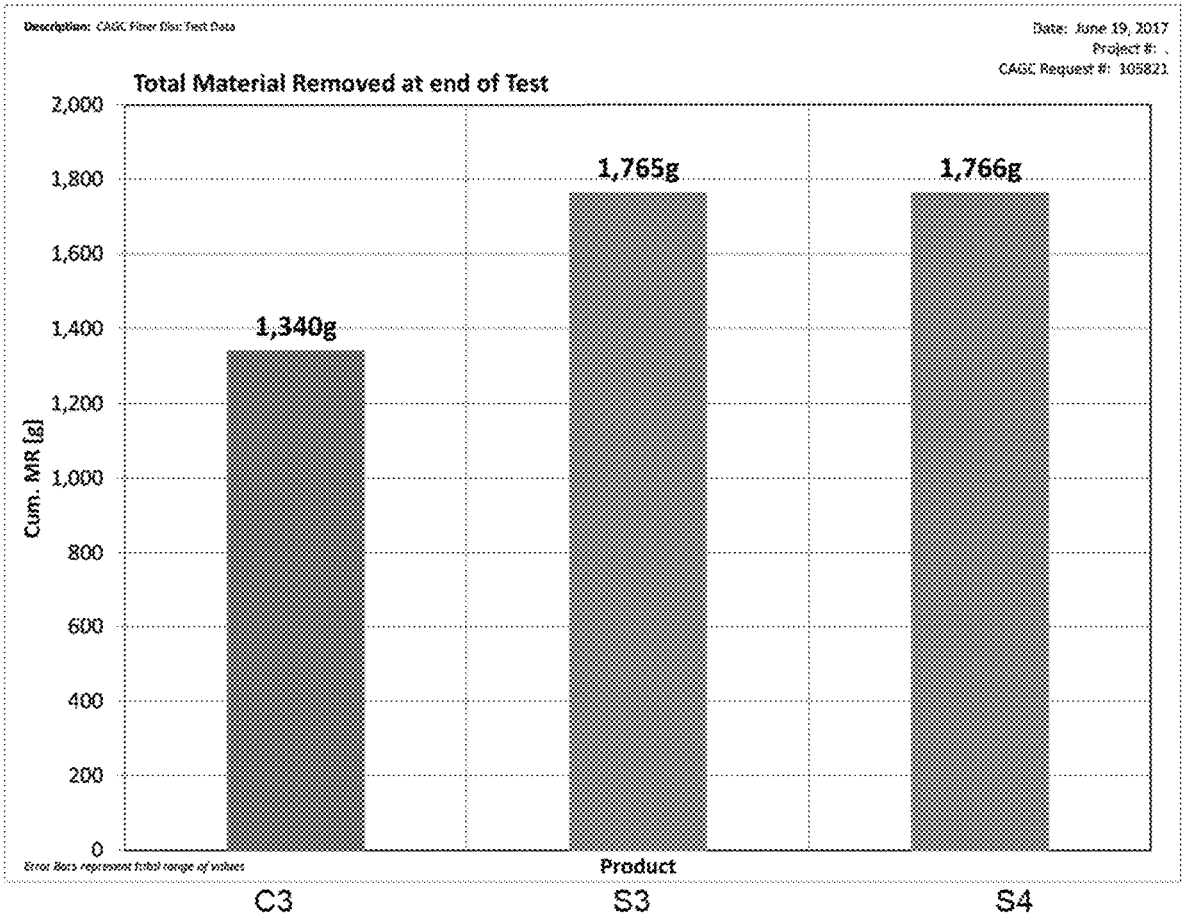
FIG. 10 is a bar graph showing cumulative material removal by inventive abrasive disc embodiments compared to a conventional abrasive disc.
Figure 11:
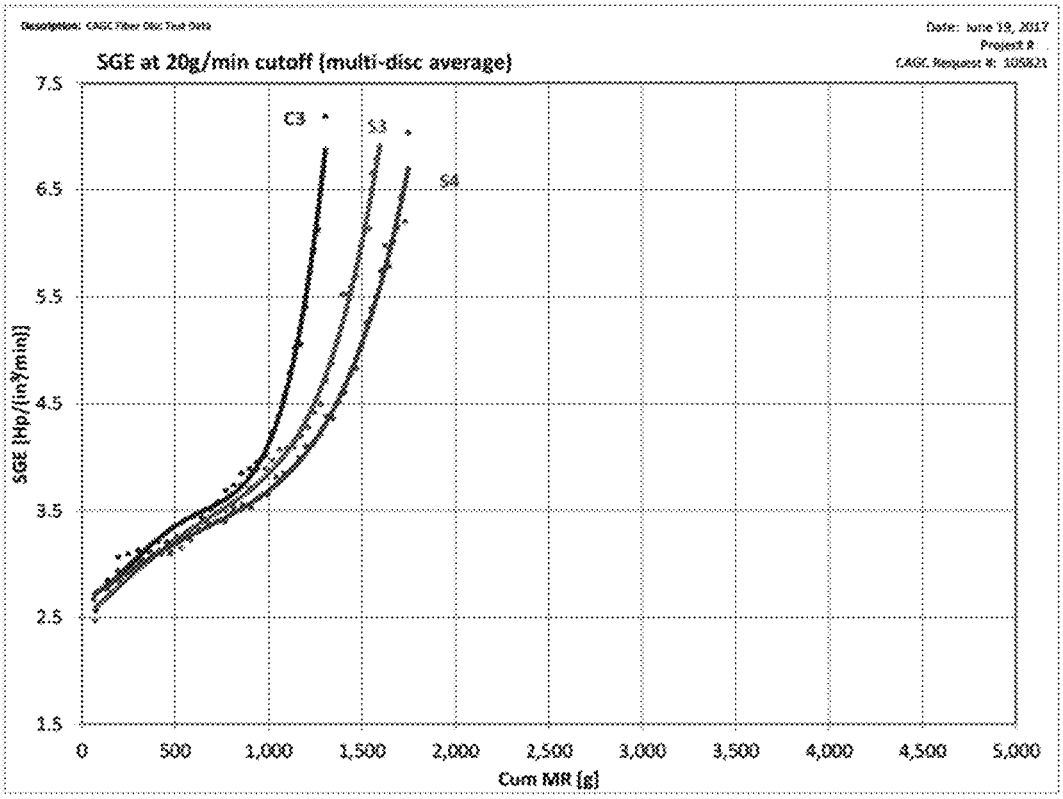
FIG. 11 is a graph showing specific grinding energy ("SGE") versus cumulative material removal by inventive abrasive disc embodiments compared to a conventional abrasive disc.

Inventive abrasive discs were successfully prepared that included grinding aid aggregates disposed on a size coat. The grinding aid aggregates included $KBF_4$ and/or Cryolite as a grinding aid. The grinding aid aggregates varied in size (avg. height) from 0.75 mm to 1.7 mm. Abrasive performance testing of the inventive discs and a conventional comparative disc was conducted on A36 Hot Rolled Steel. The comparative disc did not have grinding aid aggregates on a size coat and were used as a control sample. The construction of the abrasive discs and the abrasive performance results are shown in Table 2. The results indicated increased performance for S3 and S4. Cumulative material removed was graphed and is shown in FIG. 10. Specific grinding energy ("SGE") was measured during testing and is graphed compared to cumulative material removed as shown in FIG. 11.

TABLE 2

Abrasive Performance S3-S4 on A36 Hot Rolled Steel

| Sample | Make Coat | Abrasive Grain size | Size Coat | Avg. Cum. Cut (As a % of C3) |
|---|---|---|---|---|
| C3 | Control | 36 grit (0.5 mm) | Control | 100% |
| S3 | Control | 36 grit (0.5 mm) | Control; $KBF_4$ aggregates on size | 132% |

TABLE 2-continued

| Abrasive Performance S3-S4 on A36 Hot Rolled Steel | | | | |
|---|---|---|---|---|
| Sample | Make Coat | Abrasive Grain size | Size Coat | Avg. Cum. Cut (As a % of C3) |
| S4 | Control | 36 grit (0.5 mm) | Control; $KBF_4$/Cryolite aggregates on size | 132% |

Example 3: Belts-Abrasive Performance Testing S5-S6

Inventive abrasive belts were successfully prepared that included grinding aid aggregates that were disposed on the make coat along with the abrasive grains. The grinding aid aggregates included $KBF_4$ as a grinding aid. The grinding aid aggregates varied in size (avg. height) from 0.75 mm to 1.4 mm. The wt % of the grinding aid aggregates was varied for samples S5-S6. Abrasive performance testing of the inventive belts and conventional comparative belts was conducted on INCONEL® alloy 718 workpieces. The comparative belts did not have any grinding aid aggregates in the make coat and were used as a control sample. The construction of the abrasive belts and the abrasive performance results are shown in Table 3. Cumulative material removed was recorded. Results indicate improved abrasive performance for both S5 and S6 compared to the control. Results indicate improved abrasive performance for belts including the grinding aid aggregates, but unexpectedly and surprisingly, the performance improvement, although significant, was not linear compared to the weight % of grinding aid aggregates loaded onto the make coat.

TABLE 3

| Abrasive Performance S5 and S6 on INCONEL ® alloy 718 | | | | | | |
|---|---|---|---|---|---|---|
| Sample | Make Coat | Abrasive Grain size | Size Coat | Supersize Coat | Aggregates (wt % of total grain weight) | Avg. Cum. Cut (As a % of C4) |
| C4 | Control | 36 grit (0.5 mm) | Control | Control | — | 100% |
| S5 | Control; $KBF_4$ aggregates disposed on make coat | 36 grit (0.5 mm) | Control | Control | 10 wt % | 132% |
| S6 | Control; $KBF_4$ aggregates disposed on make coat | 36 grit (0.5 mm) | Control | Control | 20 wt % | 124% |

Example 4: Belts—Abrasive Performance Testing S7-S8

Figure 12:
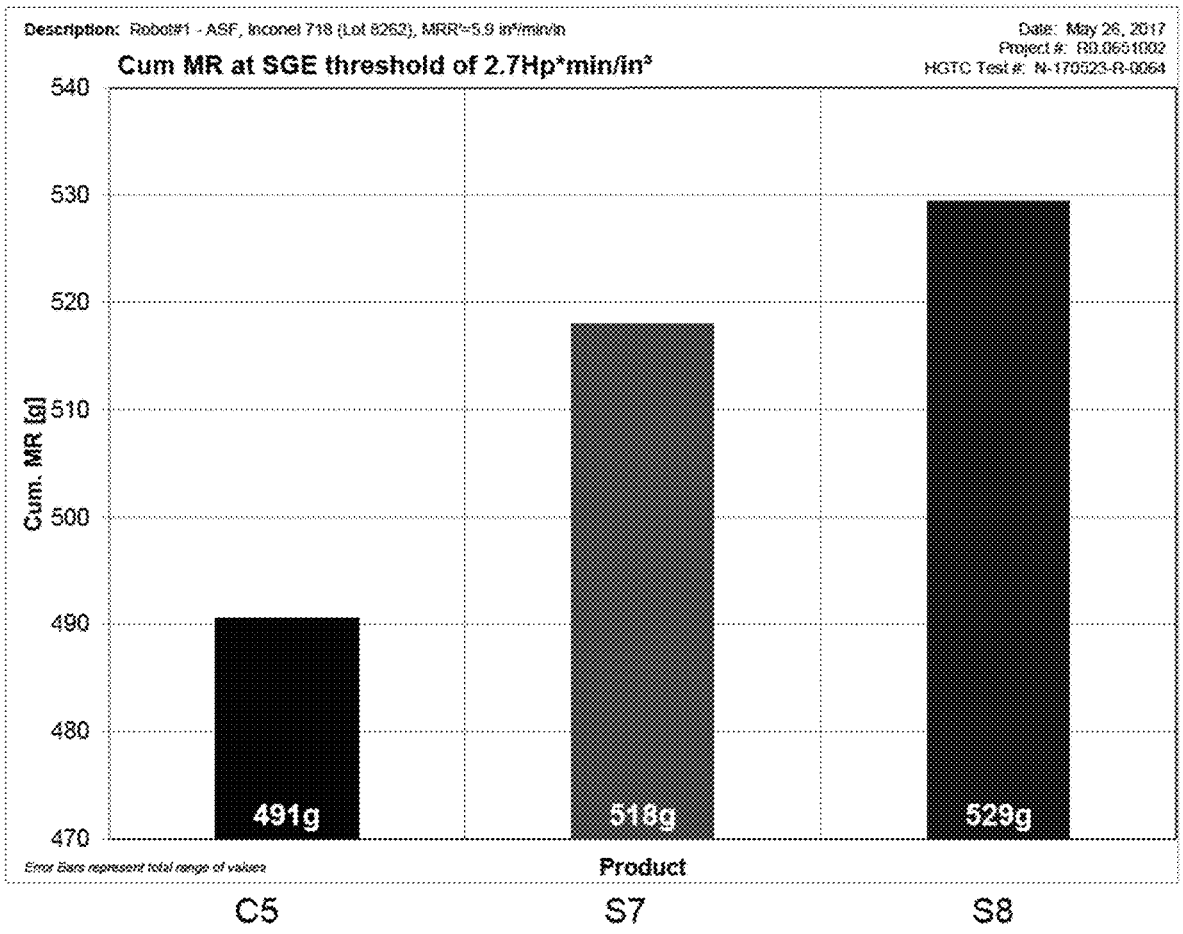
FIG. 12 is a bar graph showing cumulative material removal by inventive abrasive belt embodiments compared to a conventional abrasive belt.
Figure 13:
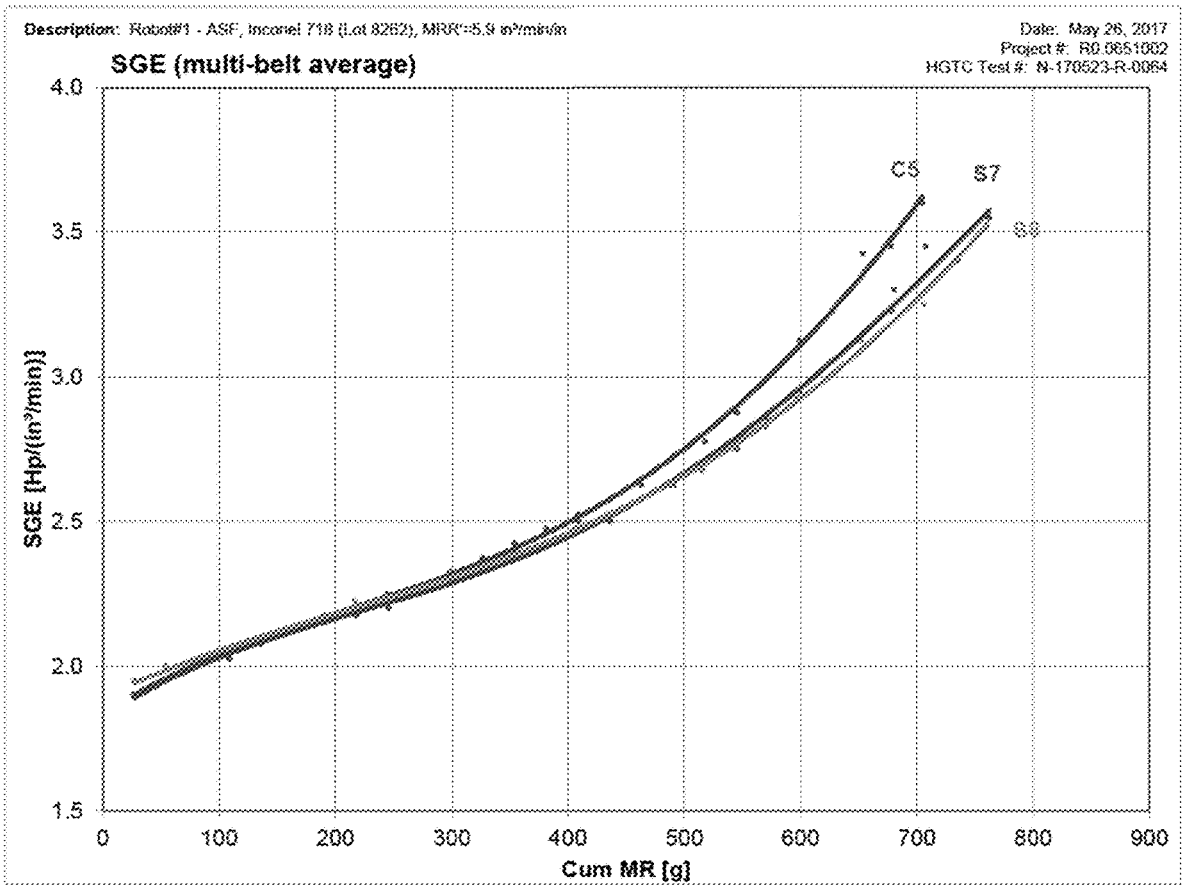
FIG. 13 is a graph showing specific grinding energy ("SGE") versus cumulative material removal by inventive abrasive belt embodiments compared to a conventional abrasive belt.
Figure 14:
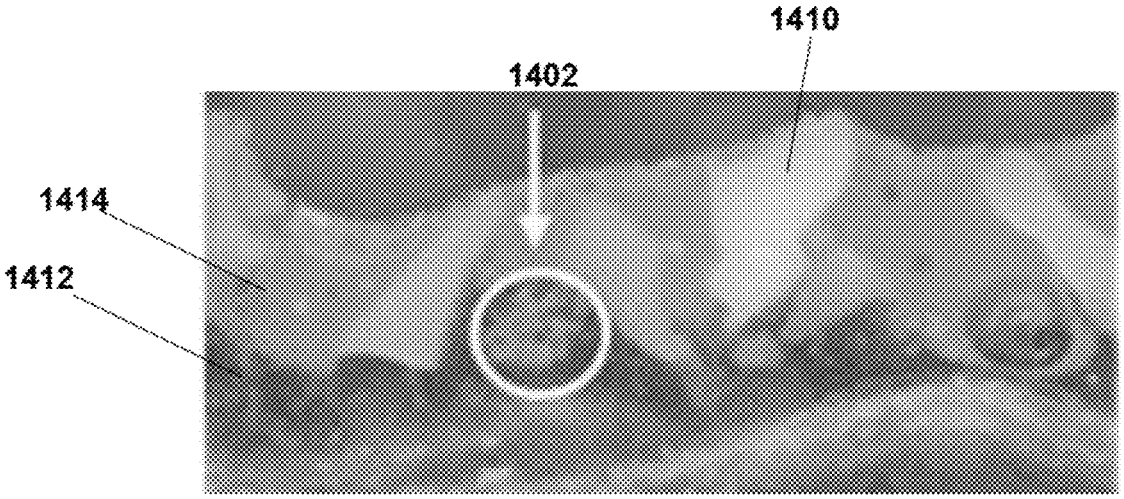
FIG. 14 is a photograph showing a cross-section of an abrasive embodiment including a grinding aid aggregate disposed on a make coat.
Figure 15:
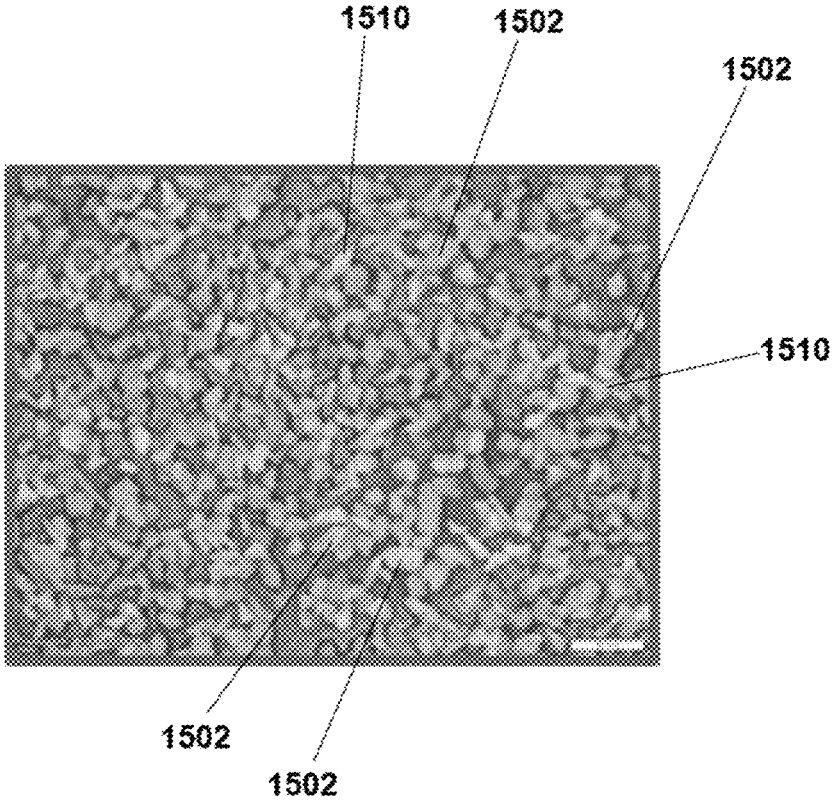
FIG. 15 is a photograph showing a top down view of an inventive abrasive disc embodiment including abrasive grains and grinding aid aggregates disposed on a make coat.

Inventive abrasive belts were successfully prepared that included grinding aid aggregates that were disposed in the size coat along with the abrasive grains. The grinding aid aggregates varied in size (avg. height) from 0.75 mm to 1.7 mm. The grinding aid aggregates included $KBF_4$ and/or Cryolite as a grinding aid. Abrasive performance testing of the inventive belts and conventional comparative belt was conducted on INCONEL® alloy 718 workpieces. The comparative belt did not have any grinding aid aggregates in the size coat and were used as a control sample. The construction of the abrasive belts and the abrasive performance results are shown in Table 4. The results indicated increased performance for S7 and S8. Cumulative material removed was graphed and is shown in FIG. 12. Specific grinding energy ("SGE") was measured during testing and is graphed compared to cumulative material removed as shown in FIG. 13.

TABLE 4

| Abrasive Performance S7-S8 on INCONEL ® alloy 718 | | | | | |
|---|---|---|---|---|---|
| Sample | Make Coat | Abrasive Grain size | Size Coat | Supersize Coat | Avg. Cum. Cut (As a % of C5) |
| C5 | Control | 36 grit (0.5 mm) | Control | Control | 100% |
| S7 | Control | 36 grit (0.5 mm) | Control; $KBF_4$ aggregates in size | Control | 106% |
| S8 | Control | 36 grit (0.5 mm) | Control; $KBF_4$/Cryolite aggregates in size | Control | 108% |

Example 5: Discs—Abrasive Performance Testing S9—A36 Hot Rolled Steel

Inventive abrasive discs embodiments were successfully prepared that included grinding aid aggregates disposed on a make coat. A size coat was disposed over the abrasive grains and grinding aid aggregates. The grinding aid aggregates had an average size (avg. height) of about 1.0 mm. There was no supersize coat. The grinding aid aggregates included $KBF_4$ as the grinding aid. Abrasive performance testing of the inventive discs and conventional comparative discs was conducted on A36 Hot Rolled Steel. The comparative discs did not have grinding aid aggregates in a make coat and were used as a control sample. The construction of the abrasive discs was the same except for the presence of the grinding aid aggregates. The abrasive performance results are shown in Table 5. The results indicated increased performance for S9 of 125% of the control sample.

TABLE 5

Abrasive Performance S9 on A36 Hot Rolled Steel

| Sample | Abrasive Grain Type | Abrasive Grain Size | Abrasive Grain Weight (lb./ream) | Grinding Aid Type | Grinding Aid Agg. Weight (lb./ream) | Grinding Aid Agg. Size | Avg. Cum. Cut (As a % of C6) |
|---|---|---|---|---|---|---|---|
| C6 | Doped Ceramic Alumina | 30 grit (0.6 mm) | 33 | — | — | — | 100% |
| S9 | Doped Ceramic Alumina | 30 grit (0.6 mm) | 33 | $KBF_4$ | 6 | 1.0 mm | 125% |

Example 6: Discs—Abrasive Performance Testing S10-S12—304 Stainless Steel

Inventive abrasive discs embodiments were successfully prepared that included grinding aid aggregates disposed on a make coat. A size coat was disposed over the abrasive grains and grinding aid aggregates. The grinding aid aggregates included $KBF_4$ and/or cryolite as a grinding aid. The $KBF_4$ grinding aid aggregates had an average size (avg. height) of about 1.0 mm. The cryolite grinding aid aggregates had an average size (avg. height) of about 0.6 mm. There was no supersize coat. Abrasive performance testing of the inventive discs and conventional comparative discs was conducted on 304 Stainless Steel. The comparative discs did not have grinding aid aggregates in a make coat and were used as control samples. The construction of the abrasive discs was the same except for the presence of the grinding aid aggregates. The abrasive performance results are shown in Table 6. The results indicated increased performance for S10 (132% of control C7), S11 (158% of control C7), and S12 (114% of control C7). In particular, the boosted performance of S11 is surprising and notable because the sample had approximately 23% less abrasive particles than the control, but was able to achieve 158% of the abrasive performance.

TABLE 6

Abrasive Performance S10-S12 on 304 Stainless Steel

| Sample | Abrasive Grain Type | Abrasive Grain Size | Abrasive Grain Weight (lb./ream) | Grinding Aid Type | Grinding Aid Agg. Weight (lb./ream) | Grinding Aid Agg. Size | Avg. Cum. Cut (As a % of C7) |
|---|---|---|---|---|---|---|---|
| C7 | Doped Ceramic Alumina | 30 grit (0.6 mm) | 43 | — | — | — | 100% |
| C8 | Doped Ceramic Alumina | 30 grit (0.6 mm) | 33 | — | — | — | 96% |
| C9 | Doped Ceramic Alumina & Brown Fused Alumina | 30 grit (0.6 mm) & 36 grit (0.5 mm) | 43 & 10 | — | — | — | 102% |
| S10 | Doped Ceramic Alumina | 30 grit (0.6 mm) | 42 | $KBF_4$ | 5.4 | 1.0 mm | 132% |
| S11 | Doped Ceramic Alumina | 30 grit (0.6 mm) | 33 | $KBF_4$ | 6 | 1.0 mm | 158% |
| S12 | Doped Ceramic Alumina | 30 grit (0.6 mm) | 42 | Cryolite | 3.9 | 0.6 mm | 114% |

Example 7: Discs—Abrasive Performance Testing S13-S15—Carbon Steel

Inventive abrasive discs embodiments were successfully prepared that included grinding aid aggregates disposed on a make coat. A size coat was disposed over the abrasive grains and grinding aid aggregates. The grinding aid aggregates included $KBF_4$ as a grinding aid. The $KBF_4$ grinding aid aggregates had an average size (avg. height) of about 1.0 mm. There was no supersize coat. Abrasive performance testing of the inventive discs and conventional comparative discs was conducted on Carbon Steel. The comparative discs did not have grinding aid aggregates in a make coat and were used as control samples. The construction of the abrasive discs was the same except for the presence of the grinding aid aggregates. The abrasive performance results are shown in Table 7. The results indicated increased performance for S13 (165% of control C10), S14 (150% of control C10), and S13 (157% of control C10). In particular, the boosted performance of all inventive samples S13-S15 is surprising and notable because the samples had approximately 23% less abrasive particles than the control, but were able to achieve from 150% to 165% of the abrasive performance. In particular, it was surprising that samples S13 and S15, which less amount of grinding aid aggregate, actually achieved better performance than S14, which had more grinding aid aggregate.

TABLE 7

Abrasive Performance S13-S15 on Carbon Steel

| Sample | Abrasive Grain Type | Abrasive Grain Size | Abrasive Grain Weight (lb./ream) | Grinding Aid Type | Grinding Aid Agg. Weight (lb./ream) | Grinding Aid Agg. Size | Avg. Cum. Cut (As a % of C10) |
|---|---|---|---|---|---|---|---|
| C10 | Doped Ceramic Alumina | 30 grit (0.6 mm) | 43 | — | — | — | 100% |
| S13 | Doped Ceramic Alumina | 30 grit (0.6 mm) | 33 | $KBF_4$ | 6 | 1.2 mm | 165% |
| S14 | Doped Ceramic Alumina | 30 grit (0.6 mm) | 33 | $KBF_4$ | 10 | 1.2 mm | 150% |
| S15 | Doped Ceramic Alumina | 30 grit (0.6 mm) | 33 | $KBF_4$ | 6 | 1 mm | 157% |

Example 8: Grinding Aid Aggregate Formulations

Grinding aid aggregates S16 comprising a polymeric binder and a grinding aid were prepared by thoroughly mixing together the ingredients to form a precursor composition. The precursor composition was forced through a sieve to form precursor aggregates. The precursor aggregates were then heated to cure the polymeric binder, remove water (drying), and form the completed grinding aid aggregates. The grinding aid aggregates were then sieved and sorted according to particle size and stored for use. Additional grinding aid aggregates S17 were prepared using the same procedure as previously described but were comprised of a polymeric binder, a clay component, and a grinding aid. The details of the cured grinding aid aggregate formulations are shown in Table 8.

TABLE 8

Grinding Aid Aggregates S16 and S17

| | S16 wt % | S17 wt % |
|---|---|---|
| Latex Rubber[1] | 6.7 | — |
| Starch[2] | — | 4.8 |
| $KBF_4$ | 93.3 | 87.0 |
| Clay[3] | — | 8.2 |
| Total | 100.0 | 100.0 |

[1]Rovene - Styrene-butadiene rubber
[2]Corn starch
[3]Champion ® Kaolin clay

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Moreover, not all of the activities described above in the general description or the examples are required, that a portion of a specific activity cannot be required, and that one or more further activities can be performed in addition to those described. Still further, the order in which activities are listed is not necessarily the order in which they are performed.

The disclosure is submitted with the understanding that it will not be used to limit the scope or meaning of the claims. In addition, in the foregoing disclosure, certain features that are, for clarity, described herein in the context of separate embodiments, can also be provided in combination in a single embodiment. Conversely, various features that are, for brevity, described in the context of a single embodiment, can also be provided separately or in any subcombination. Still, inventive subject matter can be directed to less than all features of any of the disclosed embodiments.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, or essential feature of any or all the claims.

Thus, to the maximum extent allowed by law, the scope of the present invention is to be determined by the broadest permissible interpretation of the following claims and their equivalents, and shall not be restricted or limited by the foregoing detailed description.

What is claimed is:

1. A coated abrasive article, comprising:

a backing substrate;

a polymeric make coat binder composition disposed on the backing substrate;

a plurality of abrasive particles disposed on or in the make coat binder composition;

a polymeric size coat composition disposed over the make coat composition; and a plurality of grinding aid aggregates comprising a mixture of polymeric binder composition and a grinding aid composition, wherein the grinding aid aggregates are disposed on the make coat composition, on the size coat composition, or a combination thereof, wherein the grinding aid composition comprises potassium tetrafluoroborate ($KBF_4$), cryolite ($Na_3AlF_6$), sodium ferrifluoride ($Na_3FeF_6$), sodium hexafluorostrontium ($Na_2SrF_6$), ammonium hexafluorophosphate ($NH_4PF_6$), calcium fluoride ($CaF_2$), calcium phosphate ($Ca_3(PO_4)_2$), magnesium sulfate ($MnSO_4$), lithium carbonate ($Li_2CO_3$), potassium aluminum fluoride ($K_3AlF_6$), or a combination thereof;

wherein the grinding aid aggregates comprise:

60-99 wt % of the grinding aid composition; and 1-40 wt % of the polymeric binder composition;

wherein the grinding aid aggregates are disposed to have an average particle height ($H_{GAA}$) as measured from the backing substrate, wherein the abrasive particles are disposed to have an average particle height ($H_{ABR}$) as measured from the backing substrate, and wherein the ratio of $H_{GAA}/H_{ABR}$ ranges from 0.5 to 10; and wherein the grinding aid aggregates have a total cross-sectional area ($A_{GAA}$), wherein the abrasive particles have an a total cross-sectional area ($A_{ABR}$), and wherein the ratio of $A_{ABR}/A_{GAA}$ ranges from 1 to 1000.

2. The coated abrasive of claim 1, wherein the grinding aid aggregates are disposed on the make coat composition.

3. The coated abrasive of claim 1, wherein the grinding aid aggregates are disposed on the size coat composition.

4. The coated abrasive of claim 1, wherein the grinding aid aggregates are disposed on the make coat composition and on the size coat composition.

5. The coated abrasive of claim 2, wherein the grinding aid aggregates are disposed among and between the abrasive particles.

6. The coated abrasive of claim 3, wherein the grinding aid aggregates are disposed among and between the abrasive particles.

7. The coated abrasive of claim 4, wherein the grinding aid aggregates are disposed among and between the abrasive particles, above the abrasive particles, or a combination thereof.

8. The coated abrasive article of claim 1, wherein the ratio of $H_{GAA}/H_{ABR}$ ranges from 1 to 5.

9. The coated abrasive article of claim 1, wherein the grinding aid aggregates have a particle size ranging from 0.1 mm to 5 mm.

10. The coated abrasive article of claim 9, wherein the abrasive particles have an average particle size ranging from 0.1 mm to 5 mm.

11. The coated abrasive article of claim 1, wherein the total weight of the grinding aid aggregates and the abrasive particles comprises:

80-99 wt % of the abrasive particles; and 1-20 wt % of the grinding aid aggregates.

12. The coated abrasive of claim 1, wherein the grinding aid aggregate polymeric binder composition comprises a phenolic polymeric composition, a phenolic resole composition, a urea formaldehyde composition, a urethane composition, an epoxy composition a polyimide composition, a polyamide composition, a polyester composition, an acrylate composition, a protein based composition, a starch based composition, or any combination thereof.

13. The coated abrasive of claim 12, further comprising a supersize coat composition disposed over the size coat.

14. The coated abrasive of claim 13, wherein the supersize coat comprises a mixture of polymeric binder composition and a grinding aid composition, an anti-loading composition, or a combination thereof.

15. The coated abrasive of claim 14, wherein the supersize coat composition comprises:

75-99 wt % of the grinding aid composition, the anti-loading composition, or a combination thereof; and 1-25 wt % of the polymeric binder composition.

16. The coated abrasive of claim 14, wherein the grinding aid composition of the supersize coat comprises potassium tetrafluoroborate ($KBF_4$), cryolite ($Na_3AlF_6$), sodium ferrifluoride ($Na_3FeF_6$), sodium hexafluorostrontium ($Na_2SrF_6$), ammonium hexafluorophosphate ($NH_4PF_6$), calcium fluoride ($CaF_2$), calcium phosphate ($Ca_3(PO_4)_2$), magnesium sulfate ($MnSO_4$), lithium carbonate ($Li_2CO_3$), potassium aluminum fluoride ($K_3AlF_6$), or a combination thereof.

17. The coated abrasive of claim 14, wherein the polymeric binder composition of the supersize coat comprises an acetate composition, such as polyvinyl acetate; a phenolic polymeric composition, such as a phenolic resole composition; a urea formaldehyde composition; melamine resin composition; a urethane composition; an epoxy composition; a polyimide composition; a polyamide composition; a polyester composition; an acrylate composition, such as a UV curable acrylate, or a zinc cross-linked acrylic composition; a rubber composition, such as a styrene butadiene rubber; a protein based composition; a starch based composition, or a combination thereof.

18. The coated abrasive of claim 1, wherein the grinding aid composition is potassium tetrafluoroborate ($KBF_4$).

* * * * *